US009852690B2

(12) United States Patent
Tsuge et al.

(10) Patent No.: US 9,852,690 B2
(45) Date of Patent: Dec. 26, 2017

(54) DRIVE METHOD AND DISPLAY DEVICE

(71) Applicant: JOLED INC., Tokyo (JP)

(72) Inventors: Hitoshi Tsuge, Tokyo (JP); Kouhei Ebisuno, Tokyo (JP); Shinya Ono, Osaka (JP)

(73) Assignee: JOLED INC., Tokyo (JP)

( * ) Notice: Subject to any disclaimer, the term of this patent is extended or adjusted under 35 U.S.C. 154(b) by 57 days.

(21) Appl. No.: 14/914,121

(22) PCT Filed: Aug. 26, 2014

(86) PCT No.: PCT/JP2014/004371

§ 371 (c)(1),
(2) Date: Feb. 24, 2016

(87) PCT Pub. No.: WO2015/029422

PCT Pub. Date: Mar. 5, 2015

(65) Prior Publication Data

US 2016/0203758 A1 Jul. 14, 2016

(30) Foreign Application Priority Data

Aug. 29, 2013 (JP) ..... 2013-178684

(51) Int. Cl.

| | |
|---|---|
| ***G09G 3/32*** | (2016.01) |
| ***G09G 3/325*** | (2016.01) |
| ***G09G 3/3291*** | (2016.01) |
| ***G09G 3/3258*** | (2016.01) |

(52) U.S. Cl.

CPC ..... *G09G 3/325* (2013.01); *G09G 3/3258* (2013.01); *G09G 3/3291* (2013.01);
(Continued)

(58) Field of Classification Search

CPC ..... G09G 3/30; G09G 3/3225–3/3258; G09G 2300/0819; G09G 2300/0852;
(Continued)

(56) References Cited

U.S. PATENT DOCUMENTS

| | | |
|---|---|---|
| 8,013,812 B2 | 9/2011 | Minami et al. |
| 8,552,937 B2 | 10/2013 | Minami et al. |

(Continued)

FOREIGN PATENT DOCUMENTS

| | | |
|---|---|---|
| JP | 2008-197457 | 8/2008 |
| JP | 2008-197607 | 8/2008 |

(Continued)

OTHER PUBLICATIONS

Search Report from PCT/JP2014/004371, dated Dec. 2, 2014.

*Primary Examiner* — David Tung
(74) *Attorney, Agent, or Firm* — Greenblum & Bernstein, P.L.C.

(57) ABSTRACT

By a drive method, for each of a plurality of display pixels each including an EL element, a capacitor, a drive transistor, an enable switch, and a switch, a period T21 is started by switching only the enable switch to an electrically conductive state before a period T22 in which the drive transistor is initialized, and the period T22 following the period T21 is started by switching the switch to an electrically conductive state. The period T21 is longer than a period T24 in which a threshold voltage of the drive transistor is compensated.

5 Claims, 12 Drawing Sheets

(52) U.S. Cl.
CPC ..... *G09G 2300/0426* (2013.01); *G09G 2300/0819* (2013.01); *G09G 2300/0842* (2013.01); *G09G 2300/0861* (2013.01); *G09G 2310/0251* (2013.01); *G09G 2310/0289* (2013.01); *G09G 2320/045* (2013.01); *G09G 2320/0626* (2013.01); *G09G 2330/021* (2013.01)

(58) Field of Classification Search
CPC ... G09G 2300/0861; G09G 2300/0866; G09G 2310/0251; G09G 2320/0209–2320/0223; G09G 2320/0233; G09G 2320/04; G09G 2320/043–2320/045
See application file for complete search history.

(56) References Cited

U.S. PATENT DOCUMENTS 8,730,134 B2 5/2014 Minami et al.
8,994,623 B2 3/2015 Minami et al.
2008/0191208 A1* 8/2008 Minami ..... G09G 3/3233 257/59
2008/0225027 A1* 9/2008 Toyomura ..... G09G 3/3233 345/204
2012/0062450 A1 3/2012 Minami et al.
2012/0287102 A1* 11/2012 Toyomura ..... G09G 3/3233 345/211
2013/0027369 A1 1/2013 Minami et al.
2014/0210871 A1 7/2014 Minami et al.
2015/0084030 A1 3/2015 Minami et al.

FOREIGN PATENT DOCUMENTS

JP 2008-310352 12/2008
JP 2010-261998 11/2010

* cited by examiner

DRIVE METHOD AND DISPLAY DEVICE

TECHNICAL FIELD

The present invention relates to drive methods and display devices, and more particularly to a method of driving a display device including current-driven light-emitting elements.

BACKGROUND ART

As a display device including current-driven light-emitting elements, a display device including organic electroluminescent (EL) elements is known. This display device including organic EL elements that emit light does not need backlight necessary in display devices including liquid crystals, and is thus suitable for reducing a thickness of the display device. Furthermore, without restrictions on a viewing angle, the display device including organic EL elements is expected to be used as a next-generation display device. Moreover, regarding organic EL elements, a luminance of each of light-emitting elements is controlled by a value of a current flowing in the light-emitting element. This is different from liquid crystal cells each of which is controlled by an applied voltage.

In the display device including organic EL elements, generally, the organic EL elements each of which is included in a pixel are arranged in a matrix. Switching thin film transistors (TFTs) are provided at cross-points between a plurality of scan lines and a plurality of data lines. Each of the switching TFTs is connected to a gate electrode of a corresponding drive element. By turning on the switching TFT (causing the switching TFT to be an electrically conductive state) via a selected scan line, a data signal voltage is applied to the drive element via a corresponding data line. A device in which organic EL elements are driven by drive elements is called an active matrix organic EL display device.

The active matrix organic EL display device needs to accurately apply data voltages reflecting an image signal to pixel circuits in order to perform highly accurate image displaying. In other words, it is necessary to accurately apply a data voltage between a gate and a source of each drive element, so that the drive element can cause a drive current corresponding to the data voltage to flow in a corresponding light-emitting element to cause the light-emitting element to emit light with a desired luminance.

For example, Patent Literature (PTL) 1 below discloses a method of reducing variations of device properties of a drive element by correcting a shift amount of the drive element.

CITATION LIST

Patent Literature

[PTL 1]
[Non Patent Literature] Japanese Unexamined Patent Application Publication No. 2008-310352

SUMMARY OF INVENTION

Technical Problem

However, in the method disclosed in PTL 1, if a display panel of a display device is large, influence of a line load is large. As a result, it is difficult to control a period of the shift amount correction. Furthermore, the shift amount correction is not necessarily required depending on the drive elements included in the display panel. In other words, the method disclosed in PTL 1 has a problem that highly accurate image displaying cannot be performed if the display panel of the display device is large.

In order to address the problem above, an object of the present invention is to provide a method of driving a display device and the like which are capable of performing highly accurate image displaying even if a display panel is large.

Solution to Problem

In order to achieve the above object, according to an aspect of the present invention, there is a provided a drive method used in a display device including a plurality of display pixels arranged in a matrix, each of the display pixels including: a light-emitting element; a capacitor that holds a voltage; a drive transistor having a gate electrode and a source electrode, the gate electrode being electrically conductive with a first electrode of the capacitor, and the source electrode being electrically conductive with a second electrode of the capacitor and an anode of the light-emitting element; a first switch that switches between an electrically conductive state and an electrically non-conductive state between the first power line and a drain electrode of the drive transistor; a second switch that switches between an electrically conductive state and an electrically non-conductive state between a second power line and the first electrode of the capacitor; a third switch that switches between an electrically conductive state and an electrically non-conductive state between a signal line for supplying a data signal voltage and the first electrode of the capacitor; and a fourth switch that switches between an electrically conductive state and an electrically non-conductive state between the second electrode of the capacitor and a fourth power line, each of the display pixels having: an initialization period in which the first switch and the third switch have already been switched to an electrically non-conductive state and the second switch and the fourth switch have already been switched to an electrically conductive state to initialize the drive transistor; and a threshold voltage compensation period in which the first switch and the second switch have already been switched to an electrically conductive state and the third switch and the fourth switch have already been switched to an electrically non-conductive state to compensate a threshold voltage of the drive transistor, and the drive method including, for each of the display pixels: starting a first period before the initialization period by switching only the fourth switch among the first switch, the second switch, the third switch, and the fourth switch to an electrically conductive state; and starting the initialization period following the first period, by switching the second switch to an electrically conductive state, wherein the first period is longer than the threshold voltage compensation period.

Advantageous Effects of Invention

The method of driving a display device and the like according to the present invention are capable of performing highly accurate image displaying even if a display panel is large.

DESCRIPTION OF EMBODIMENTS

Figure 1:
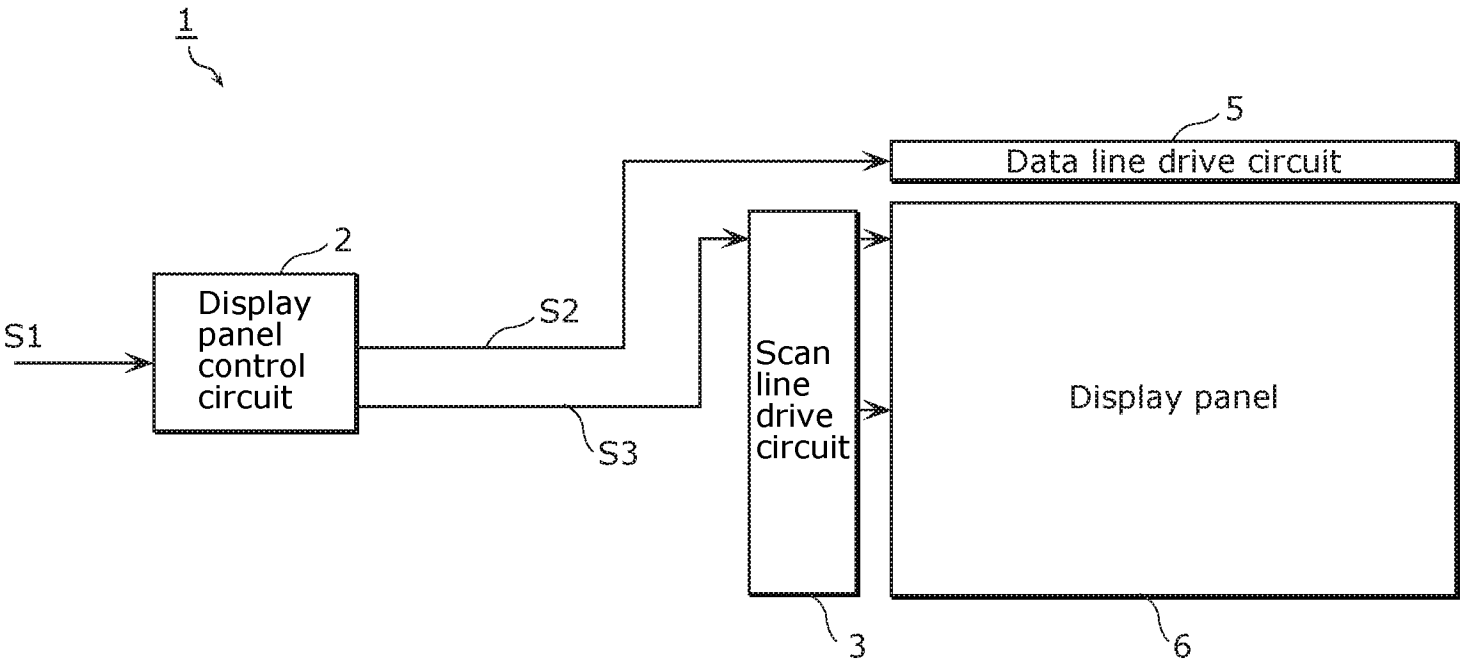
FIG. 1 is an example of a functional block diagram illustrating a display device according to an embodiment.

According to an aspect of the present invention, a drive method used in a display device includes a plurality of display pixels arranged in a matrix, each of the display pixels including: a light-emitting element; a capacitor that holds a voltage; a drive transistor having a gate electrode and a source electrode, the gate electrode being electrically conductive with a first electrode of the capacitor, and the source electrode being electrically conductive with a second electrode of the capacitor and an anode of the light-emitting element; a first switch that switches between an electrically conductive state and an electrically non-conductive state between the first power line and a drain electrode of the drive transistor; a second switch that switches between an electrically conductive state and an electrically non-conductive state between a second power line and the first electrode of the capacitor; a third switch that switches between an electrically conductive state and an electrically non-conductive state between a signal line for supplying a data signal voltage and the first electrode of the capacitor; and a fourth switch that switches between an electrically conductive state and an electrically non-conductive state between the second electrode of the capacitor and a fourth power line, each of the display pixels having: an initialization period in which the first switch and the third switch have already been switched to an electrically non-conductive state and the second switch and the fourth switch have already been switched to an electrically conductive state to initialize the drive transistor; and a threshold voltage compensation period in which the first switch and the second switch have already been switched to an electrically conductive state and the third switch and the fourth switch have already been switched to an electrically non-conductive state to compensate a threshold voltage of the drive transistor, and the drive method including, for each of the display pixels: starting a first period before the initialization period by switching only the fourth switch among the first switch, the second switch, the third switch, and the fourth switch to an electrically conductive state; and starting the initialization period following the first period, by switching the second switch to an electrically conductive state, wherein the first period is longer than the threshold voltage compensation period Here, for example, it is possible that the fourth power line is arranged in a direction perpendicular to the first power line and the second power line.

It is also possible that the drive method further includes, for each of the display pixels: starting a second period before the first period, by ending an emission period by switching the first switch to an electrically non-conductive state, the second period being a period in which the first switch, the second switch, the third switch, and the fourth switch have already been switched to an electrically non-conductive state, the emission period being a period in which the light-emitting element emits light; and starting the first period following the second period, by switching the fourth switch to an electrically conductive state.

Here, for example, it is further possible that each of the first switch, the second switch, the third switch, the fourth switch, and the drive transistor is an N-channel thin-film transistor.

According to another aspect of the present invention, a display device includes a plurality of display pixels arranged in a matrix, each of the display pixels having: a light-emitting element; a capacitor that holds a voltage; a drive transistor having a gate electrode and a source electrode, the gate electrode being electrically conductive with a first electrode of the capacitor, and the source electrode being electrically conductive with a second electrode of the capacitor and an anode of the light-emitting element; a first switch that switches between an electrically conductive state and an electrically non-conductive state between the first power line and a drain electrode of the drive transistor; a second switch that switches between an electrically conductive state and an electrically non-conductive state between a second power line and the first electrode of the capacitor; a third switch that switches between an electrically conductive state and an electrically non-conductive state between a signal line for supplying a data signal voltage and the first electrode of the capacitor; a fourth switch that switches between an electrically conductive state and an electrically non-conductive state between the second electrode of the capacitor and a fourth power line; and a control unit configured to cause: an initialization period in which the first switch and the third switch have already been switched to an electrically non-conductive state and the second switch and the fourth switch have already been switched to an electrically conductive state to initialize the drive transistor; and a threshold voltage compensation period in which the first switch and the second switch have already been switched to an electrically conductive state and the third switch and the fourth switch have already been switched to an electrically non-conductive state to compensate a threshold voltage of the drive transistor, wherein the fourth power line is arranged in a direction perpendicular to the first power line and the second power line, and the control unit is further configured to, for each of the display pixels: cause a first period to start before the initialization period by switching only the fourth switch to an electrically conductive state; and cause the initialization period following the first period to start by switching the second switch to an electrically conductive state, the first period being longer than the threshold voltage compensation period.

According to still another aspect of the present invention, a drive method is used in a display device including a plurality of display pixels arranged in a matrix, each of the display pixels including: a light-emitting element; a capacitor that holds a voltage; a drive transistor having a gate electrode and a source electrode, the gate electrode being electrically conductive with a first electrode of the capacitor, and the source electrode being electrically conductive with a second electrode of the capacitor and an anode of the light-emitting element; a first switch that switches between an electrically conductive state and an electrically non-conductive state between the first power line and a drain electrode of the drive transistor; a second switch that switches between an electrically conductive state and an electrically non-conductive state between a second power line and the first electrode of the capacitor; a third switch that switches between an electrically conductive state and an electrically non-conductive state between a signal line for supplying a data signal voltage and the first electrode of the capacitor; and a fourth switch that switches between an electrically conductive state and an electrically non-conductive state between the second electrode of the capacitor and a fourth power line, each of the display pixels having a threshold voltage compensation period in which the first switch and the second switch have already been switched to an electrically conductive state and the third switch and the fourth switch have already been switched to an electrically non-conductive state to compensate a threshold voltage of the drive transistor, the drive method comprising, for each of the display pixels: starting a first period following the threshold voltage compensation period, by ending the threshold voltage compensation period by switching the first switch to be an electrically non-conductive state; and starting a writing period after an end of the first period, the writing period being a period in which the third switch has already been switched to an electrically conductive state and the first switch, the second switch and the fourth switch have already been switched to an electrically non-conductive state to apply a voltage to the capacitor.

Here, for example, it is possible that the drive method further includes, for each of the display pixels: starting a second period following the first period, by ending the first period by switching the second switch to be an electrically non-conductive state; and starting the writing period following the second period, by ending the second period by switching the third switch to be an electrically conductive state.

Hereinafter, the display device and the drive method according to the aspects of the present invention are described in detail with reference to the accompanying drawings.

It should be noted that the subsequently-described embodiment describes a specific example of the present invention. The numerical values, shapes, materials, structural components, the arrangement and connection of the structural components, steps, the order of the steps, etc. indicated in the following embodiment are mere examples, and are not intended to limit the scope of the present invention. Among the structural components in the following embodiment, components not recited in any one of the independent claims which indicate the broadest concepts of the present disclosure are described as arbitrary structural components. Furthermore, the respective figures are schematic diagrams and are not necessarily precise illustrations.

Embodiment

In the present embodiment, the description is given for the case where organic electroluminescent (EL) elements are used as light-emitting elements in a display device according to an aspect of the present disclosure.

FIG. 1 is an example of a functional block diagram of a display device according to the present embodiment.

The display device 1 illustrated in FIG. 1 includes a display panel control circuit 2, a scan line drive circuit 3, a data line drive circuit 5, and a display panel 6.

An example of the display panel 6 is an organic EL panel. The display panel 6 includes N scan lines (where N=1080, for example) arranged parallel to one another, N lighting control lines, M source signal lines arranged perpendicular to the N scan lines, and the like (all the lines are not illustrated). The display panels 6 further includes pixel circuits (not illustrated) each of which includes TFTs and an EL element and is provided at a corresponding one of cross-points between the source signal lines and the scan lines. Hereinafter, a set of pixel circuits connected to the same scan line is referred to as a "display line" for the sake of convenience. In other words, the display panel 6 includes N display lines each of which includes M EL elements.

The display panel control circuit 2 is an example of the control unit according to the aspect of the present invention. The display panel control circuit 2 generates, based on a display data signal S1, a control signal S2 for controlling the data line drive circuit 5, and outputs the generated control signal S2 to the data line drive circuit 5. The display panel control circuit 2 also generates, based on an input synchronization signal, a control signal S3 for controlling the scan line drive circuit 3. Then, the display panel control circuit 2 provides the generated control signal S3 to the scan line drive circuit 3.

Here, the display data signal S1 is a signal indicating display data that includes an image signal, a vertical synchronization signal, and a horizontal synchronization signal. The image signal is a signal designating pixel values for each frame. Each of the pixel values is gradation information. The vertical synchronization signal is a signal for synchronizing timings of processes performed in a vertical direction of the screen. In this example, the vertical synchronization signal is a signal based on which process timings are determined for each frame. The horizontal synchronization signal is a signal for synchronizing timings of processes performed in a horizontal direction of the screen. In this example, the horizontal synchronization signal is a signal based on which process timings are respectively determined for the display lines.

The control signal S2 includes the image signal and the horizontal synchronization signal. The control signal S3 includes the vertical synchronization signal and horizontal synchronization signal.

The data line drive circuit 5 drives the source signal lines in the display panel 6, based on the control signal S2 generated by the display panel control circuit 2. More specifically, the data line drive circuit 5 outputs a source signal to each of the pixel circuits, based on the image signal and the horizontal synchronization signal.

The scan line drive circuit 3 drives the scan lines in the display panel 6, based on the control signal S3 generated by the display panel control circuit 2. More specifically, based on the vertical synchronization signal and the horizontal synchronization signal, the scan line drive circuit 3 outputs a scan signal, an reference signal (ref signal), an enable signal, and an initialization signal (init signal) to each of the pixel circuits at least on a display line basis.

Thus, the display device 1 has the structure as described above.

It should be noted that the display device 1 may further include a Central Processing Unit (CPU), a recording medium, such as a Read Only Memory (ROM), which stores a control program, a working memory, such as a Random Access Memory (RAM), and a communication circuit. For example, the display data signal S1 is generated by the CPU executing the control program.

Figure 2:
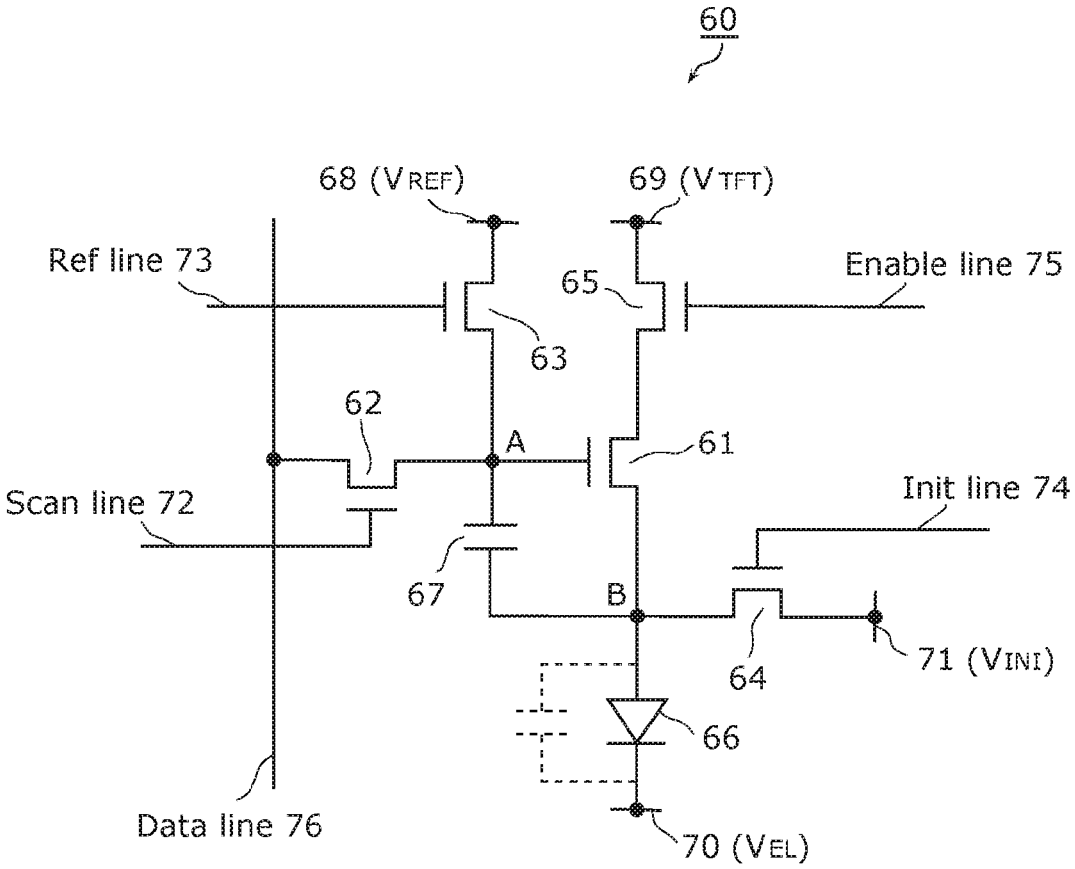
FIG. 2 is a diagram illustrating an example of a circuit structure of a light-emitting pixel included in the display device according to the embodiment.

FIG. 2 is a diagram illustrating an example of a circuit structure of each of the display pixels in the display device according to the present embodiment.

The pixel circuit 60 illustrated in FIG. 2 is one of the pixels in the display panel 6. The pixel circuit 60 has a function of emitting light by receiving a data signal (data signal voltage) provided through a data line 76.

The pixel circuit 60 is an example of one of the display pixels (light-emitting pixels) arranged in a matrix according to the aspect of the present invention. The pixel circuit 60 includes a drive transistor 61, a switch 62, a switch 63, a switch 64, an enable switch 65, an EL element 66, and a capacitor 67. The pixel circuit 60 also includes a data line 76 (data line), a reference voltage power line 68 ($V_{REF}$), an EL anode power line 69 ($V_{TFT}$), an EL cathode power line 70 ($V_{EL}$), and an initialization power line 71 ($V_{INI}$).

In this example, the data line 76 is an example of the signal line (source signal line) for supplying a data signal voltage according to the aspect of the present invention.

The reference voltage power line 68 ($V_{REF}$) is an example of the second power line according to the aspect of the present invention. A reference voltage $V_{REF}$ that determines a voltage value of a first electrode of the capacitor 67 is supplied through the reference voltage power line 68 ($V_{REF}$). The EL anode power line 69 ($V_{TFT}$) is an example of the first power line according to the aspect of the present invention. The EL anode power line 69 ($V_{TFT}$) is a power line at the high voltage side and used to determine a potential of a drain electrode of the drive transistor 61. The EL cathode power line 70 ($V_{EL}$) is a power line at the low voltage side and is connected to a second electrode (cathode) of the EL element 66. The initialization power line 71 ($V_{INI}$) is an example of the fourth power line according to the aspect of the present invention. The initialization power line 71 ($V_{INI}$) initializes a voltage between a source and a gate of the drive transistor 61, in other words, a voltage at the capacitor 67.

The EL element 66 is an example of one of the light-emitting elements arranged in a matrix according to the aspect of the present invention. The EL element 66 has an emission period in which a drive current flows in the EL element 66 to cause the EL element 66 to emit light, and a non-emission period in which a drive current does not flow in the EL element 66 and the EL element 66 does not emit light. More specifically, a drive current of the drive transistor 61 causes the EL element 66 to emit light. An example of the EL element 66 is an organic EL element. The EL element 66 has the cathode (second electrode) connected to the EL cathode power line 70, and an anode (first electrode) connected to the source (source electrode) of the drive transistor 61. Here, a voltage applied to the EL cathode power line 70 is $V_{EL}$, for example, 0 V.

The drive transistor 61 is a drive element driven by a voltage and controls the supply of a current to the EL element 66. The drive transistor 61 causes a current (drive current) to flow into the EL element 66 to cause the EL element 66 to emit light. More specifically, the gate electrode of the drive transistor 61 is electrically conducive with the first electrode of the capacitor 67, and the source electrode of the drive transistor 61 is electrically conductive with the second electrode of the capacitor 67 and the anode of the EL element 66.

The drive transistor 61 causes a drive current, which is a current corresponding to a data signal voltage, to flow in the EL element 66 to causes the EL element 66 to emit light, when (i) the switch 63 (second switch) is turned OFF (non-conductive state) to cause an electrically non-conductive state between the reference voltage power line 68 (second power line) and the first electrode of the capacitor 67 and (ii) the enable switch 65 (first switch) is turned ON (conductive state) to cause an electrically conductive state between the EL anode power line 69 (first power line) and the drain electrode of the drive transistor 61. Here, the voltage applied to the EL anode power line 69 is $V_{TFT}$, for example, 20 V. Therefore, the drive transistor 61 converts the data signal voltage (data signal) applied to the gate electrode into a signal current corresponding to the data signal voltage (data signal), and provides the resulting signal current to the EL element 66.

Furthermore, the drive transistor 61 causes the drive current not to flow in the EL element 66 to prevent the EL element 66 from emitting light, when (i) the switch 63 (second switch) is turned OFF (non-conductive state) to cause an electrically non-conductive state between the reference voltage power line 68 (second power line) and the first electrode of the capacitor 67 and (ii) the enable switch 65 (first switch) is turned OFF (non-conductive state) to cause an electrically non-conductive state between the EL anode power line 69 (first power line) and the drain electrode of the drive transistor 61.

Moreover, a threshold voltage of the drive transistor 61 is compensated, when (i) the switch 63 (second switch) is turned ON (conductive state) to cause an electrically conductive state between the reference voltage power line 68 (second power line) and the first electrode of the capacitor 67, and (ii) the switch 62 (third switch) is turned OFF (non-conductive state), (iii) the switch 64 (fourth switch) is turned OFF (non-conductive state), and (iv) the enable switch 65 (first switch) is turned ON (conductive state) to cause an electrically non-conductive state between the data line 76 (signal line) and the first electrode of the capacitor 67 and between the second electrode of the capacitor 67 and the initialization power line 71 (fourth power line) and to cause an electrically conductive state between the EL anode power line 69 (first power line) and the drain electrode of the drive transistor 61. The details are omitted here but will be described later.

The capacitor 67 is an example of the capacitor for holding a voltage according to the aspect of the present invention. The capacitor 67 holds a voltage based on which an amount of a current caused by the drive transistor 61 to flow is determined. More specifically, the second electrode (electrode closer to a node B) of the capacitor 67 is connected between the source (closer to the EL cathode power line 70) of the drive transistor 61 and the anode (the first electrode) of the EL element 66. The first electrode (electrode closer to a node A) of the capacitor 67 is connected to the gate of the drive transistor 61. The first electrode of the capacitor 67 is further connected to the reference voltage power line 68 ($V_{REF}$) via the switch 63.

For example, even after the switch 63 is turned OFF (non-conductive state), the capacitor 67 maintains the applied reference voltage ($V_{REF}$), and keeps applying the reference voltage ($V_{REF}$) to the gate of the drive transistor 61. Furthermore, after the switch 62 is turned ON (conductive state) to apply the data signal voltage and thereby turn off the switch 63 (non-conductive state), the capacitor 67 maintains the data signal voltage and applies the held data signal voltage to the source and the gate of the drive transistor 61. Then, the capacitor 67 causes the drive transistor 61, for which the enable switch 65 has already been turned ON (conducive state), to supply the drive current to the EL element 66. The capacitor 67 holds the data signal voltage as charge obtained by integrating the data signal voltage by electrostatic capacitance.

The switch 62 is an example of the third switch according to the aspect of the present invention. The switch 62 switches between an electrically conductive state and an electrically non-conductive state between the data line 76 (signal line) for supplying the data signal voltage and the first electrode of the capacitor 67. More specifically, the switch 62 is a switching transistor, and one terminal of a drain and a source of the switch 62 is connected to the data line 76, the other terminal of the drain and the source of the switch 62 is connected to the first electrode of the capacitor 67, and a gate of the switch 62 is connected to the scan line 72 that is the above-described scan line. In other words, the switch 62 has a function of writing, to the capacitor 67, a data signal voltage (data signal) corresponding to an image signal voltage (image signal) supplied through the data line 76.

The switch 63 is an example of the second switch according to the aspect of the present invention. The switch 63 switches between an electrically conductive state and an electrically non-conductive state power between the reference voltage power line 68 (second power line) for supplying the reference voltage $V_{REF}$ and the first electrode of the capacitor 67. More specifically, the switch 63 is a switching transistor, and one terminal of a drain and a source of the switch 63 is connected to the reference voltage power line 68 ($V_{REF}$), the other terminal of the drain and the source of the switch 63 is connected to the first electrode of the capacitor 67, and a gate of the switch 63 is connected to the ref line 73. In other words, the switch 63 has a function of applying the reference voltage ($V_{REF}$) to the first electrode of the capacitor 67 (the gate of the drive transistor 61).

The switch 64 is an example of the fourth switch according to the aspect of the present invention. The switch 64 switches between an electrically conductive state and an electrically non-conductive state between the second electrode of the capacitor 67 and the initialization power line 71 (fourth power line). More specifically, the switch 64 is a switching transistor, and one terminal of a drain and a source of the switch 64 is connected to the initialization power line 71 ($V_{INI}$), the other terminal of the drain and the source of the switch 64 is connected to the second electrode of the capacitor 67, and a gate of the switch 64 is connected to the init line 74. In other words, the switch 64 has a function of applying the initialization voltage ($V_{INI}$) to the second electrode of the capacitor 67 (source of the drive transistor 61).

The enable switch 65 is an example of the first switch according to the aspect of the present invention. The enable switch switches between an electrically conductive state and an electrically non-conductive state between the EL anode power line 69 (first power line) and the drain electrode of the drive transistor 61. More specifically, the enable switch 65 is a switching transistor, and one terminal of a drain and a source of the enable switch 65 is connected to the EL anode power line 69 ($V_{TFT}$), the other terminal of the drain and the source of the enable switch 65 is connected to the drain electrode of the drive transistor 61, and a gate of the enable switch 65 is connected to the enable line 75. In other words, the enable switch 65 has functions of lighting and performing threshold correction control. More specifically, the enable switch 65 has a function of applying a potential ($V_{TFT}$) to the drain electrode of the drive transistor 61, and a function of causing a compensation operation of a threshold voltage Vth of the drive transistor 61.

Each of the pixel circuits 60 has the above-described structure.

Hereinafter, the description is given assuming that the switches 62 to 64 and the enable switch 65 included in the pixel circuit 60 are n-type TFTs. However, the present invention is not limited to this example. The switches 62 to 64 and the enable switch 65 may be p-type TFTs. Furthermore, the switches 62 to 64 and the enable switch 65 may include n-type TFTs and p-type TFTs. Each of the signal lines connected to the p-type TFTs can be considered to has a reverse voltage level of the voltage level indicated below.

A potential difference between the voltage $V_{REF}$ of the reference voltage power line 68 and the voltage $V_{INI}$ of the initialization power line 71 is set to be a voltage higher than a maximum threshold voltage of the drive transistor 61.

Furthermore, the voltage $V_{REF}$ of the reference voltage power line 68 and the voltage $V_{INI}$ of the initialization power line 71 are set not to cause a current to flow into the EL element 66. More specifically, the voltage $V_{REF}$ and the voltage $V_{INI}$ are set to satisfy the followings.

voltage $V_{INI}$<voltage $V_{EL}$+(forward current threshold voltage of EL element 66), and (voltage $V_{REF}$ of reference voltage power line 68)<voltage $V_{EL}$+(forward current threshold voltage of EL element 66)+(threshold voltage of drive transistor 61)

Here, the voltage $V_{EL}$ is a voltage at the EL cathode power line 70 as described previously.

Next, the drive method of the pixel circuit illustrated in FIG. 2 is described with reference to FIGS. 3 to 4J.

Figure 3:
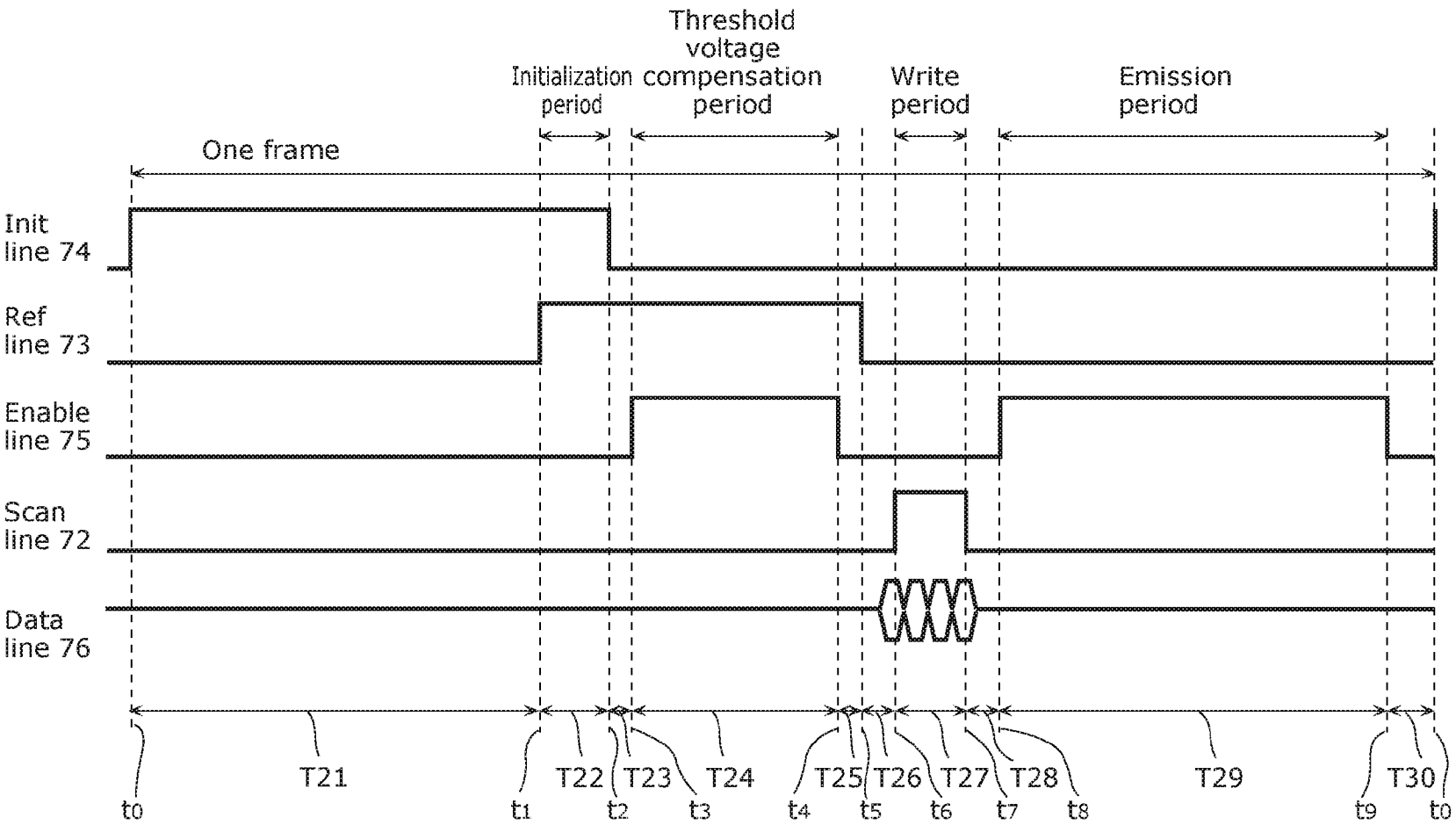
FIG. 3 is a timing diagram for explaining an example of operations performed in driving the display device according to the embodiment.

FIG. 3 is a timing diagram for explaining an example of operations performed in driving the display device according to the present embodiment. Each of FIGS. 4A to 4J is a diagram illustrating an example of an operation performed by the pixel circuit in the timing diagram of FIG. 3. In FIG. 3, a horizontal axis indicates a time. In the horizontal axis direction, waveforms of voltages of the scan line 72, the ref line 73, the init line 74, and the enable line 75, which are included in a pixel circuit 60 and correspond to one of the n rows of pixel circuits 60 included in the display panel 6, are illustrated.

The drive method (scan method) according to the present embodiment is realized by performing operations from a period T21 to a period T30 by the pixel circuit 60 having the structure illustrated in FIG. 2.

The following describes an example of the operations of the pixel circuit 60 in more detail.

(Period T21)

In FIG. 3, the period T21 from time t0 to time t1 is a period in which only the switch 64 is set to be an electrically conductive state to stabilize a potential of the node B (to set the potential of the node B to the voltage $V_{INI}$ of the initialization power line 71).

Figure 4A:
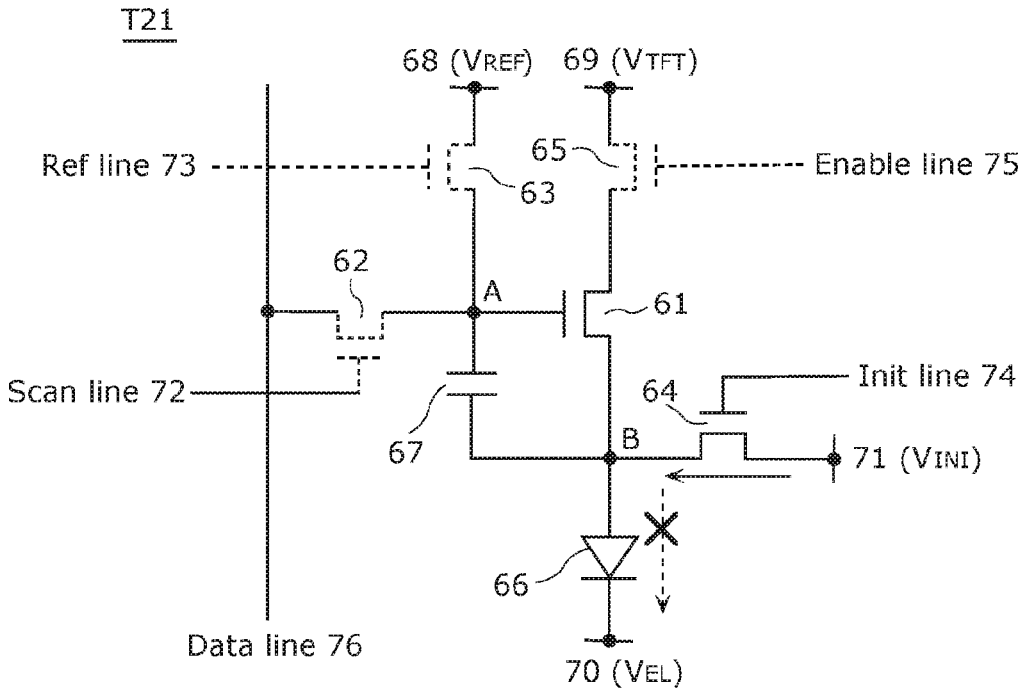
FIG. 4A is a diagram illustrating an example of an operation performed by a pixel circuit in the timing diagram of FIG. 3.

More specifically, as illustrated as an operation state of the pixel circuit 60 in FIG. 4A, at time to, the scan line drive circuit 3 maintains voltage levels of the scan line 72, the ref line 73, and the enable line 75 LOW, and changes a voltage level of the init line 74 from LOW to HIGH. In other words, at time t0, the switch 62, the switch 63, and the enable switch 65 are kept being in an electrically non-conductive state (OFF), and the switch 64 is changed to be an electrically conductive state (ON).

As described above, the operation of the init line 74 provides the period T21 in which only the switch 64 among the switch 62, the switch 63, the switch 64, and the enable switch 65 is in an electrically conductive state. As a result, the potential of the node B can be set to the voltage $V_{INI}$ of the initialization power line 71 in a shorter period. Furthermore, the capacitor 67 decreases the potential of the node A to a voltage obtained by adding the voltage $V_{INI}$ of the initialization power line 71 to the voltage between the gate and the source of the drive transistor 61 in an emission period in a previous frame.

The reason why the period T21 is provided is as follows.

If a size of the display panel 6 included in the display device 1 or a size of each pixel (pixel circuit 60) is large, a capacitance of the EL element 66 increases and a line time constant of the initialization power line 71 thereby increases. As a result, changing the voltage of the node B to the voltage $V_{INI}$ of the initialization power line 71 requires a time. Therefore, if the period T21 in which the switch 64 is changed to be an electrically conductive state beforehand is provided, it is possible to set the potential of the node B to the voltage $V_{INI}$ of the initialization power line 71 (apply the voltage $V_{INI}$) in a short period.

It should be noted that application of the voltage $V_{REF}$ of the reference voltage power line 68 to the node A also requires a time. However, charging/discharging of the voltage $V_{REF}$ depends on the capacitor 67 and a line time constant of the reference voltage power line 68. In other words, although the line time constant of the reference voltage power line 68 and the line time constant of the initialization power line 71 are approximately equal to each other, a capacitance of EL element 66>a capacitance of capacitor 67, and a capacitance ratio of (EL element 66)/(capacitor 67) is 1.3 to 9. Therefore, discharge of the EL element 66 (writing of the voltage $V_{INI}$ of the initialization power line 71 to the potential of the node B) requires a more time than discharge of the capacitor 67 (writing of the voltage $V_{REF}$ of the reference voltage power line 68 to the potential of the node A).

Furthermore, there are following advantages if only the switch 64 is changed to be an electrically conductive state in the period T21, and changing of the switch 63 to be an electrically conductive state is delayed.

If the period T21 is provided to apply the voltage $V_{INI}$ of the initialization power line 71 to be the potential of the node B, it is possible to reduce a load of writing the voltage $V_{REF}$ of the reference voltage power line 68 to the node A. More specifically, the provision of the period T21 allows the voltage of the node A to be set to a low voltage. As a result, the operation to be performed using the reference voltage power line 68 is only supplying a current (voltage) for charging the pixel circuit 60. In other words, since the voltage $V_{REF}$ of the reference voltage power line 68 is not used as a voltage for charging the EL element 66, there is an advantage of reducing a load of the reference voltage power line 68.

Furthermore, in order to further reduce the load of the reference voltage power line 68, it is also possible to arrange the initialization power line 71 in a direction perpendicular to the EL anode power line 69 and the reference voltage power line 68. This case is described below with reference to the corresponding figures.

Figure 5:
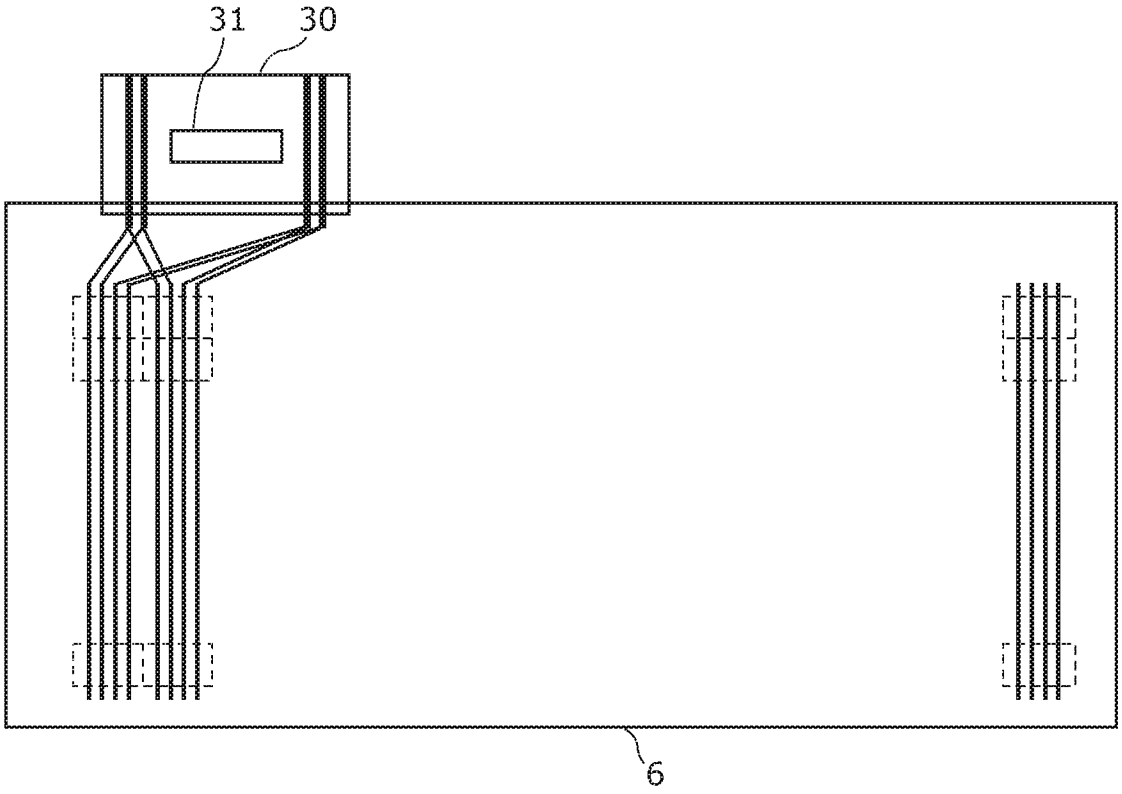
FIG. 5 is a diagram illustrating a layout example of power lines according to the embodiment.
Figure 6:
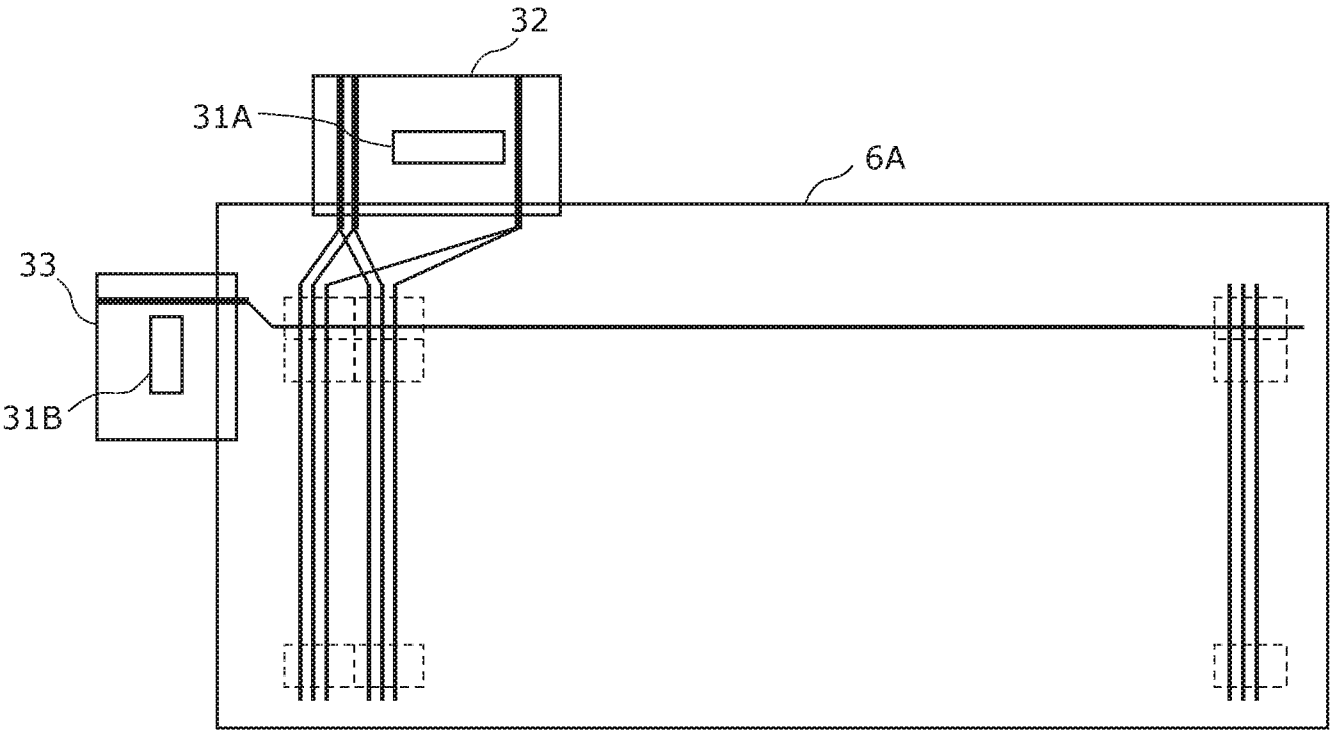
FIG. 6 is a diagram illustrating a layout example of the power lines according to the embodiment.
Figure 7:
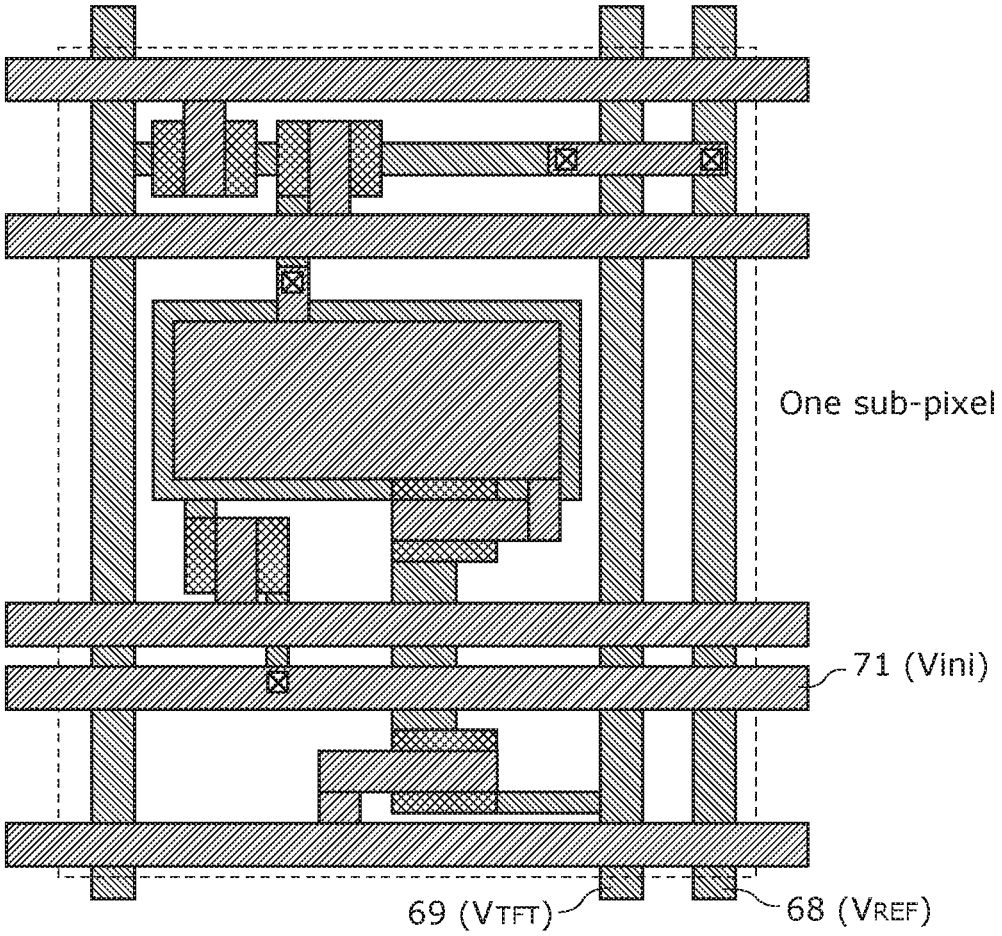
FIG. 7 is a diagram illustrating a layout example of the power lines illustrated in FIG. 6.

Each of FIG. 5 and FIG. 6 is a diagram illustrating a layout example of power lines according to the present embodiment. FIG. 7 is a diagram illustrating a layout example of the power lines illustrated in FIG. 6.

Hereinafter, the reference voltage power line 68, the EL anode power line 69, the EL cathode power line 70, and the initialization power line 71 are referred to also as power lines.

For example, as illustrated in FIG. 5, all the four power lines may be arranged in a short-side direction of the display panel 6. However, in this case, it is difficult to reduce resistance at an outer periphery of the display panel 6 and at a flexible printed circuit 30 of the scan line drive circuit 3 including a driver integrated circuit (IC) 31.

In contrast, for example, as illustrated in FIG. 6, one of the four power lines is arranged in a long-side direction of the display panel 6A (in other words, one of the power lines are arranged perpendicular to the other three power lines). This layout can increase the number of terminals and a line width per power line, at the outer periphery of a display panel 6A and at flexible printed circuits 32 and 33 of the scan line drive circuit 3 including driver ICs 31A and 31B. As a result, a power loss caused by a voltage drop can be reduced.

As one of the power lines which is arranged laterally, the initialization power line 71 may be selected as described previously. In other words, the initialization power line 71 may be selected as the power line to be arranged perpendicular to the other three power lines.

More specifically, although there are four kinds of power lines which are necessary in the pixel circuit 60, if the power lines extend to the outside of the display panel 6A, line resistance causes a voltage drop. Therefore, in order to suppress this voltage drop, the reference voltage power line 68 and the EL cathode power line 70, which influence power consumption of the display panel 6A, may extend in the short-side direction of the display panel 6A (direction along the source signal line). Furthermore, since voltage varying of the power source directly influences a display luminance of the reference voltage power line 68, the reference voltage power line 68 may extend in the short-side direction of the display panel 6A in FIG. 6 (direction along the source signal line). If the reference voltage power line 68 is arranged in the short-side direction, the number of the capacitors 67 charged or discharged by the reference voltage power line 68 is the number of pixels corresponding to a length of the periods T22 to T24. Therefore, the number of capacitors as loads is decreased, thereby facilitating the charging/discharging.

On the other hand, since the initialization power line 71 needs to charge EL elements 66 corresponding to one row together in one horizontal scan period, the initialization power line 71 has a specifically large time constant and requires a time for charging/discharging. Therefore, the initialization power line 71 may extend in a long-side direction of the display panel 6A in FIG. 6 (direction perpendicular to the source signal line). Since the number of power lines extending in the long-side direction decreases, it is possible to increase a line width of the lines extending from the periphery of the display panel (panel periphery) to the outside. Since the line width of the initialization power line 71 can be increased even on the display screen, a line delay of the initialization power line 71 can be reduced, thereby decreasing a time required to stabilize the node B.

Although, in each of FIG. 5 and FIG. 6, in a part of the scan line drive circuit 3, the flexible printed circuit 30, 32, or 33 formed by Tape Automated Bonding (TAB) is illustrated, the present invention is not limited to this example. The flexible printed circuits 30, 32, and 33 may be formed by Chip on Film (COF) or Tape Carrier Package (TCP), or by Chip on Glass (COG) by which the driver ICs 31 etc. are provided on the display panel 6. The above explains a layout of the power lines. The mode of the drivers may be any modes, such as a mode by which the drivers are embedded in the panel periphery. Furthermore, although each of FIG. 5 and FIG. 6 illustrates the example where the power lines are provided only at one side of the display panel 6, the present invention is not limited to this example and power can be supplied from the both sides of the display panel 6.

Regarding the length of the period T21, a period for charging the node B needs to be enough to cause the node B to have the voltage $V_{INI}$ of the initialization power line 71. In a light-emitting state, a voltage of the node B has a potential that increases from $V_{EL}$ by approximately 3 V to 8 V. The voltage $V_{INI}$ depends on a threshold voltage of the drive transistor 61. However, in order to apply a voltage lower than the voltage $V_{EL}$ by approximately 1 V to 7 V, a potential change of the node B in the period T21 needs to be approximately 4 V to 15 V. On the other hand, since the length of the period 124 is up to the completion of the threshold value detection performed by the drive transistor 61, the potential difference of the node B from the end of the initialization period to the threshold voltage detection is approximately 1 V to 9 V, which is lower than the potential change amount in the period T21.

The charge supplied to change the potential of the node B to a predetermined potential is supplied through the initialization power line 71 in the period T21, and through the EL anode power line 69 in the period T24.

Regarding a line layout, the EL anode power line 69, which influences panel power, is arranged in the short-side direction of the display panel in order to decrease resistance as much as possible. This line layout allows the EL anode power line 69 to supply a current to the node B of each pixel via one power line. A load of the power line is small. However, since the current is supplied via the drive transistor 61, a possible amount of the current is limited and approximately a double of a maximum pixel current required in the panel display. On the other hand, since the initialization power line 71 is arranged in the long-side direction, each of pixels, which are connected to one power line and perform the sequence of FIG. 3 at the same time, can receive only a current obtained by dividing a current into the number of the pixels arranged in the long-side direction. However, since the pixels connected to one power line can receive the resulting charging current directly from the power circuit, the charging current can be large. The charging current can be 10,000 times or more of the maximum pixel current. Even if 4000 pixels×RGB are connected in the long-side direction, like pixels in a 4K2K display panel, it is possible to cause the charging current to be larger than a current supplied through the EL anode power line 69.

In consideration of a potential variation amount, a current amount supplied per pixel, and a line time constant of a power source, a charging period of the node B seems to be determined based on a difference of the potential variation amount, and the period T21 needs to be 1.6 times to 4 times as long as the period T24.

The extension of the period T21 causes a potential of the node A to change depending on a potential change of the node B, and to have a potential lower than a potential obtained in a period T29. Therefore, there are advantages that the potential of node A, which has increased in the emission period T29, is decreased to a voltage close to the reference voltage $V_{REF}$ of the reference voltage power line 68, that charging/discharging of the node A caused by the reference voltage $V_{REF}$ of the reference voltage power line 68 which influences gradation display is further reduced, and that the potential varying is decreased. As a result, it is possible to realize gradation display having finer widths.

Although it has been described with reference to FIG. 6 and FIG. 7 that the initialization power line 71 is arranged in a direction perpendicular to the EL anode power line 69 and the reference voltage power line 68, the present invention is not limited to this example. It is also possible that the reference voltage power line 68 is arranged in a direction perpendicular to the EL anode power line 69 and the initialization power line 71. In this case, the period T22 for applying a voltage to the reference voltage power line 68 is extended.

In this case, when the power lines extend to the outside of the display panel 6 (the outside of the panel), a direction of the extension is different between the reference voltage power line 68 and the other power lines. It is therefore possible to increase a width of the power lines extending to the outside of the panel. As a result, it is easy to design the resistance of the reference voltage power line 68 arranged from the periphery of the display panel 6 to an external power circuit to be small. Therefore, influence of voltage varying of the power source, which results from a voltage drop caused by the resistance, hardly occurs, and display with high homogeneity can be achieved.

(Period T22: Initialization Period)

A period T22 from time t1 to time t2 illustrated in FIG. 3 is an initialization period in which a voltage is applied between the source and the gate of the drive transistor 61. The applied voltage is necessary to cause a drain current to flow into the drive transistor 61 in order to perform threshold voltage compensation in the drive transistor 61.

Figure 4B:
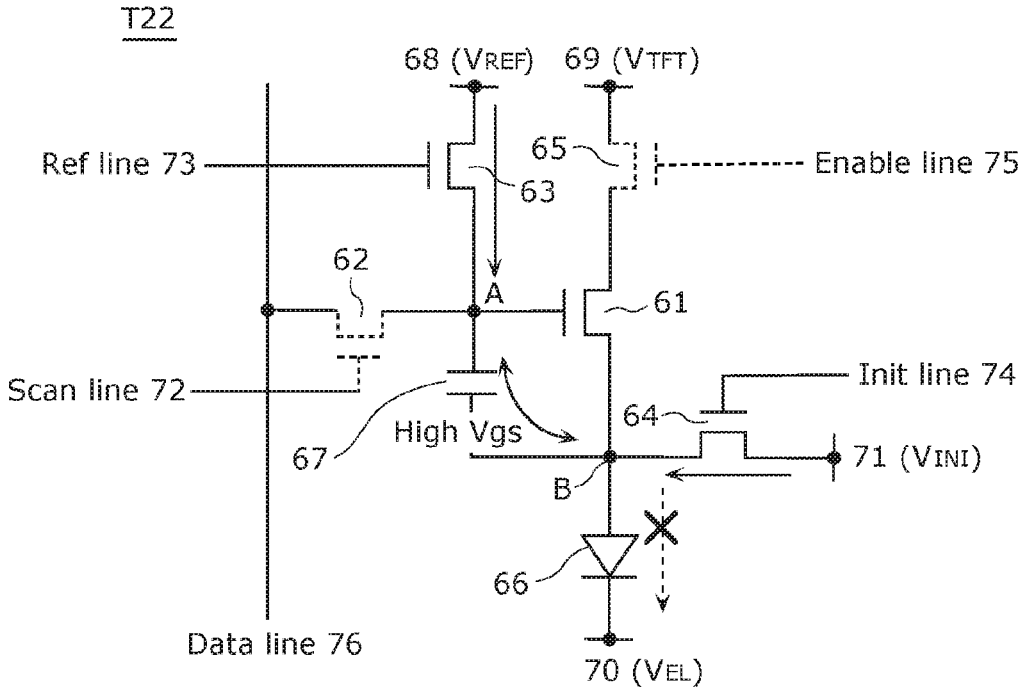
FIG. 4B is a diagram illustrating an example of an operation performed by the pixel circuit in the timing diagram of FIG. 3.

More specifically, as illustrated as an operation state of the pixel circuit 60 in FIG. 4B, at time t1, the scan line drive circuit 3 maintains the voltage levels of the scan line 72 and the enable line 75 LOW, maintains the voltage level of the init line 74 HIGH, and changes the voltage level of the ref line 73 from LOW to HIGH. In other words, at time t1, the switch 62 and the enable switch 65 are kept being in the electrically non-conductive state (OFF), the switch 64 is kept being in the electrically conductive state (ON), and the switch 63 is changed to be an electrically conductive state (ON).

Therefore, the potential of the node A is set to the voltage $V_{REF}$ of the reference voltage power line 68. Here, since the switch 64 is in the electrically conductive state, the potential of the node B is set to the voltage $V_{INI}$ of the initialization power line 71. In other words, the voltage $V_{REF}$ of the reference voltage power line 68 and the voltage $V_{INI}$ of the initialization power line 71 are applied to the drive transistor 61.

The period T22 is set to have a length (period) necessary to cause the potential of the node A and the potential of the node B to have predetermined potentials.

Furthermore, as described previously, the voltage between the source and the gate of the drive transistor 61 needs to be set to a voltage enough to obtain an initial drain current necessary to perform a threshold correction operation. Therefore, a potential difference between the voltage $V_{REF}$ of the reference voltage power line 68 and the voltage $V_{INI}$ of the initialization power line 71 is set to be a voltage higher than the maximum threshold voltage of the drive transistor 61. Moreover, the voltage $V_{REF}$ and the voltage $V_{INI}$ are set not to cause a current to flow into the EL element 66. More specifically, the voltage $V_{REF}$ and the voltage $V_{INI}$ are set to satisfy: voltage $V_{INI}$<voltage $V_{EL}$+(forward current threshold voltage of EL element 66); and $V_{REF}$<voltage $V_{EL}$+(forward current threshold voltage of EL element 66)+(threshold voltage of drive transistor 61).

(Period T23)

A period T23 from time t2 to time t3 illustrated in FIG. 3 is a period in which both the switch 64 and the enable switch 65 are not in an electrically conductive state.

Figure 4C:
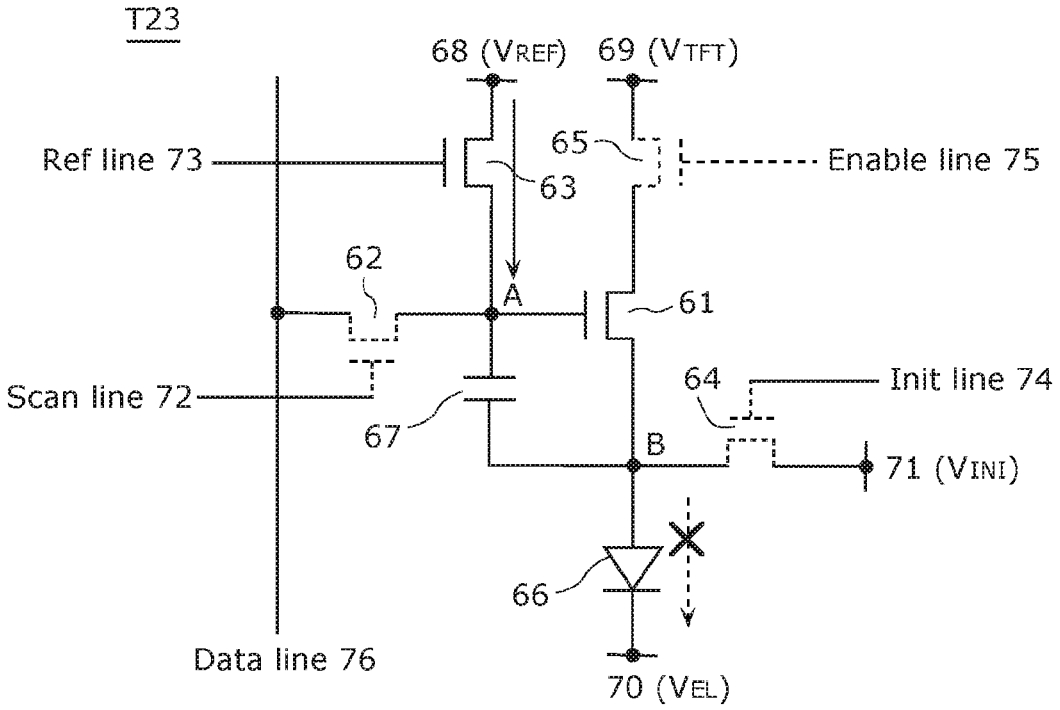
FIG. 4C is a diagram illustrating an example of an operation performed by the pixel circuit in the timing diagram of FIG. 3.

More specifically, as illustrated as an operation state of the pixel circuit 60 in FIG. 4C, at time t2, the scan line drive circuit 3 maintains the voltage levels of the scan line 72 and the enable line 75 LOW, maintains the voltage level of the ref line 73 HIGH, and changes the voltage level of the init line 74 from HIGH to LOW. In other words, at time t2, the switch 62 and the enable switch 65 are kept being in the electrically non-conductive state (OFF), the switch 63 is kept being in the electrically conductive state (ON), and the switch 64 is changed to be an electrically non-conductive state (OFF).

As described above, the operation of the init line 74 provides the period T23 in which the switch 64 is set to be an electrically non-conductive state. The period T23 can prevent that both the switch 64 and the enable switch 65 are in an electrically conductive state at the same time due to a lack of the period T23 and thereby a through current flows between the EL anode power line 69 and the initialization power line 71 via the enable switch 65, the drive transistor 61, and the switch 64.

A through current in the above case is enough for the drive transistor 61 to perform the threshold compensation operation. Therefore, if the threshold voltage of the drive transistor 61 is low, it is expected that a current with gradation higher than the highest gradation flows.

The EL anode power line 69 has a large line width according to a current flowing in the EL element 66 in an emission period to decrease a voltage drop. Therefore, even if a through current flows in the period T23, influence of voltage varying is small. On the other hand, the initialization power line 71 only needs to charge the node B to have a predetermined potential, and the initialization power line 71 does not need a current. Therefore, the line width of the initialization power line 71 is not as large as the line width of the EL anode power line 69. However, if a through current occurs, the line resistance of the EL anode power line 69 causes a voltage drop and increases an amount of the voltage drop. Therefore, there is a risk of failing an application of the predetermined potential to the node B. In order to prevent this, increase of the line width of the initialization power line 71 is considered. However, there is a method of providing (inserting) the period T23 without increasing the line width, as described in the present disclosure. The insertion (provision) of the period T23 can reduce a current flowing in the initialization power line 71 as described earlier. As a result, it is possible to apply the predetermined voltage to the node B even through a thin line.

(Period T24: Threshold Compensation Period)

Next, a period T24 from time t3 to time t4 in FIG. 3 is a threshold compensation period in which a threshold voltage of the drive transistor 61 is compensated.

Figure 4D:
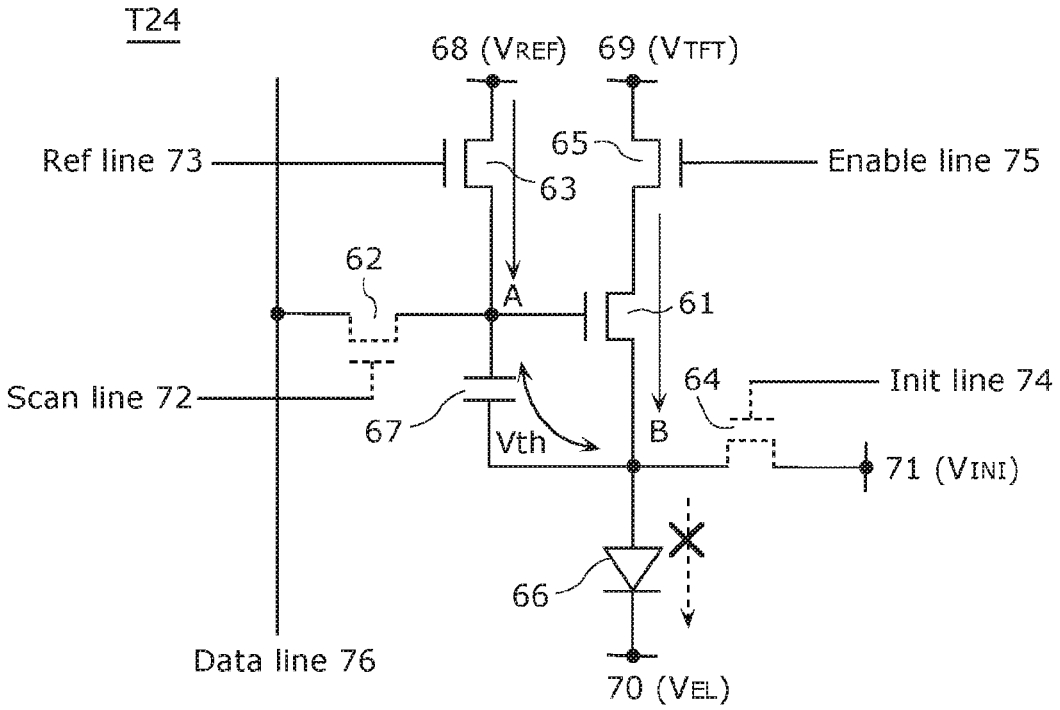
FIG. 4D is a diagram illustrating an example of an operation performed by the pixel circuit in the timing diagram of FIG. 3.

More specifically, as illustrated as an operation state of the pixel circuit 60 in FIG. 4D, at time t3, the scan line drive circuit 3 maintains voltage levels of the scan line 72 and the init line 74 LOW, maintains the voltage level of the ref line 73 HIGH, and changes a voltage level of the enable line 75 from LOW to HIGH. In other words, at time t3, the switch 62 and the switch 64 are kept being in the electrically non-conductive state (OFF), the switch 63 is kept being in the electrically conductive state (ON), and the enable switch 65 is changed to be an electrically conductive state (ON).

Here, since the voltage is set in the initialization period (period T22) as described previously, a current does not flow in the EL element 66. The drive transistor 61 receives a drain current caused by the voltage $V_{TFT}$ of the EL anode power line 69. The receiving changes a source potential of the drive transistor 61. In other words, the source potential of the drive transistor 61 changes to a potential that causes no drain current supplied by the voltage $V_{TFT}$ of the EL anode power line 69.

As described above, if the enable switch 65 is turned to be an electrically conductive state (ON) in the state where the voltage $V_{REF}$ of the reference voltage power line 68 is applied to the gate electrode of the drive transistor 61, a threshold compensation operation of the drive transistor 61 can start.

Then, at a time of completion of the period T24 (time t4), a potential difference between the node A and the node B (voltage between the gate and the source of the drive transistor 61) becomes a potential difference corresponding to the threshold voltage of the drive transistor 61, and this voltage is held (stored) in the capacitor 67.

(Period T25)

A period T25 from time t4 to time t5 in FIG. 3 is a period in which the threshold compensation operation is ended.

Figure 4E:
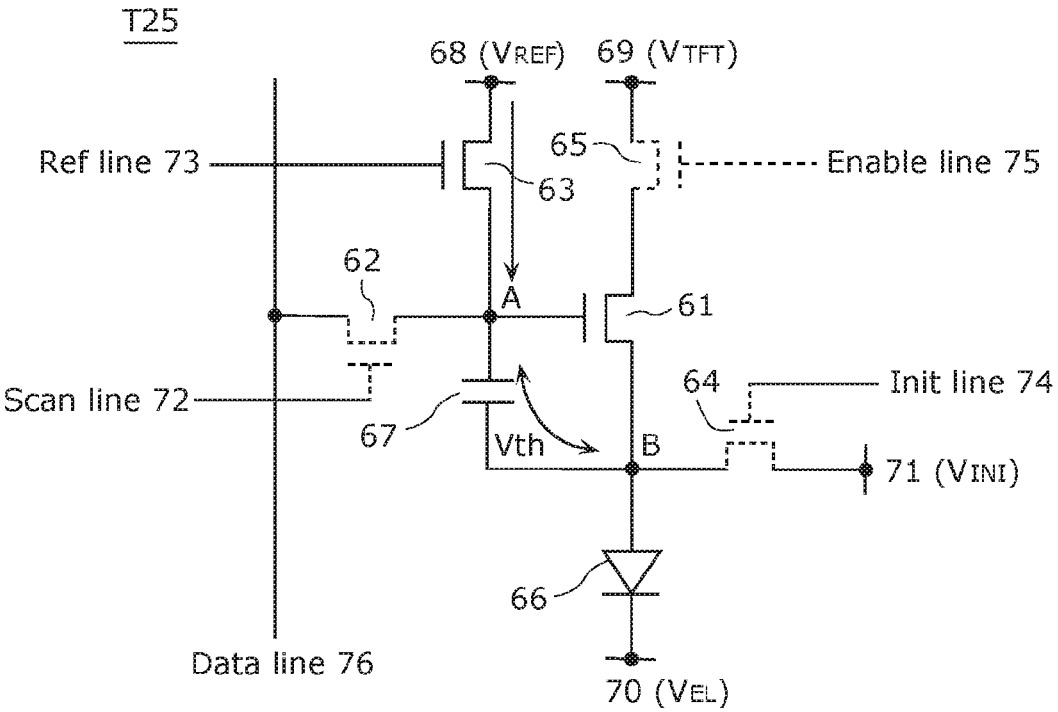
FIG. 4E is a diagram illustrating an example of an operation performed by the pixel circuit in the timing diagram of FIG. 3.

More specifically, as illustrated as an operation state of the pixel circuit 60 in FIG. 4E, the scan line drive circuit 3 maintains voltage levels of the scan line 72 and the init line 74 LOW, maintains the voltage level of the ref line 73 HIGH, and changes the voltage level of the enable line 75 from HIGH to LOW. In other words, at time t4, the switch 62 and the switch 64 are kept being in the electrically non-conductive state (OFF), the switch 63 is kept being in the electrically conductive state (ON), and the enable switch 65 is changed to be an electrically non-conductive state (OFF).

As described above, the operation of the enable line 75 provides the period T25 in which the enable switch 65 is set to be an electrically non-conductive state. The period T25 can stop supply of a current flowing from the EL anode power line 69 to the node B via the drive transistor 61. As a result, it is possible to complete the threshold compensation operation before proceeding to a next operation.

(Period T26)

A period T26 from time t5 to time t6 in FIG. 3 is a period in which the switch 63 is set to be an electrically non-conductive state (OFF) to prevent that both the data signal voltage supplied through the data line 76 and the voltage $V_{REF}$ of the reference voltage power line 68 are applied to the node A at the same time.

Figure 4F:
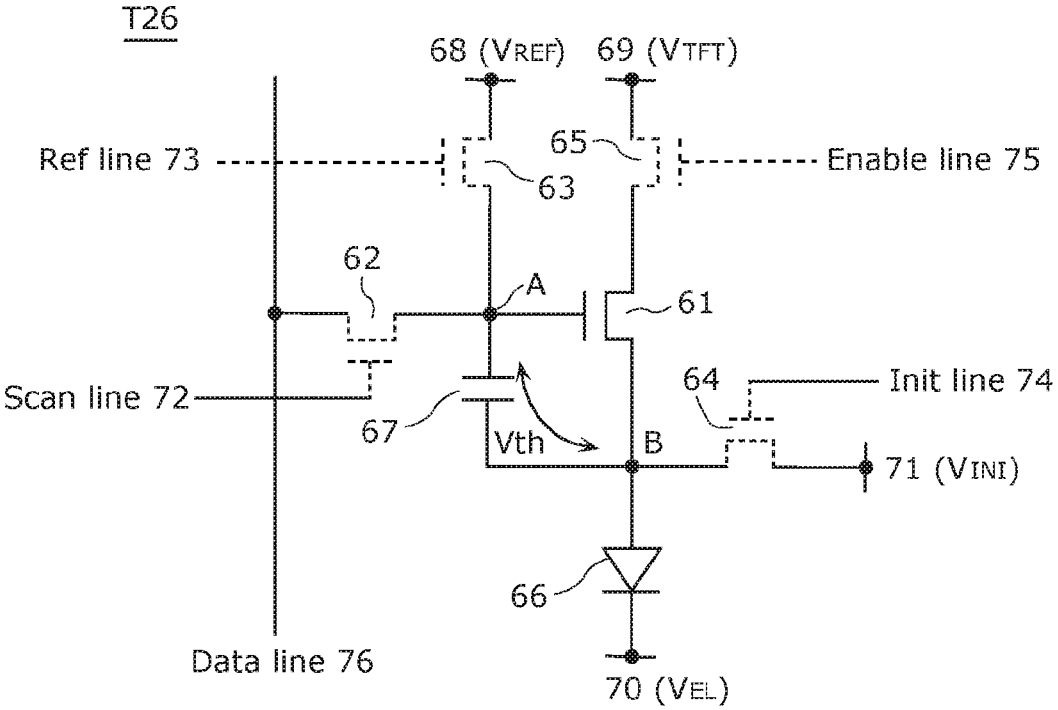
FIG. 4F is a diagram illustrating an example of an operation performed by the pixel circuit in the timing diagram of FIG. 3.

More superficially, as illustrated as an operation state of the pixel circuit 60 in FIG. 4F, at time t5, the scan line drive circuit 3 maintains the voltage levels of the scan line 72, the init line 74, and the enable line 75 LOW, and changes the voltage level of the ref line 73 from HIGH to LOW. In other words, at time t5, the switch 62, the switch 64, and the enable switch 65 are kept being in the electrically non-conductive state (OFF), and the switch 63 is changed to be an electrically non-conductive state (OFF).

As described above, the operation of the ref line 73 provides the period T26 in which the switch 63 is also set to be an electrically non-conductive state to set the switches 62 and 63 to be an electrically non-conductive state (OFF). The period T26 can prevent that both the data signal voltage supplied from the switch 62 through the data line 76 and the voltage $V_{REF}$ of the reference voltage power line 68 are applied to the node A at the same time.

It is also possible that both the switch 63 and the enable switch 65 are set to be an electrically non-conductive state (OFF) at the same time, thereby integrating the periods T25 and 126 into one period.

However, the provision of the two-stage periods of the period T25 and the period T26 produces the following advantages. The provision of the period T25 and the period T26 shortens, as much as possible, a period in which the potential of the node A that is a gate potential of the drive transistor 61 is unstable, reduces potential varying that would occur in the unstable period, and eventually provides more accurate display based on image signal.

Furthermore, since gradation display is caused by a potential difference between a potential of the node A at the end of the period T26 (time t6) and a potential of the node A at the completion of writing of the data signal voltage (image signal) applied through the data line 76 (time t27). Therefore, it is preferable that the potential varying of the node A in the period 126 is small. Ideally, since the voltage $V_{REF}$ of the reference voltage power line 68 is applied to the node A in the period 124 and the potential of the node A is held in the period T25, a display luminance of the EL element 66 is determined based on the potential difference (image signal voltage−voltage $V_{REF}$).

It should be noted that the period 126 is preferably the shortest enough to accurately reflect the potential difference (image signal voltage−voltage $V_{REF}$) connected to the enable line 75 is connected to the drain of the drive transistor 61 as illustrated in FIG. 4F (FIG. 2). If the enable switch 65 is an n-type transistor, an ON resistance of the enable switch 65 is likely to be high, and a voltage drop caused by the ON resistance affects power consumption of the display panel 6. Therefore, the enable switch 65 is formed to lower the ON resistance as much as possible. Common known methods of lowering ON resistance include a method by increasing a channel size of the enable switch 65, and a method by increasing an ON control voltage of the enable line 75, for example. However, in any known methods, a rising period of the enable line 75 is extended.

Therefore, in the present embodiment, the provision of the period T25 in which the enable line 75 falls prior to the ref line 73 can shorten the period in which the voltage of the node A is unstable, in other words, shorten the rising period.

(Period T27: Writing Period)

Next, a period T27 from time t6 to time t7 in FIG. 3 is a writing period in which an image signal voltage (data signal voltage) according to display gradation is retrieved from the data line 76 and provided to the pixel circuit 60 via the switch 62 and written in the capacitor 67.

Figure 4G:
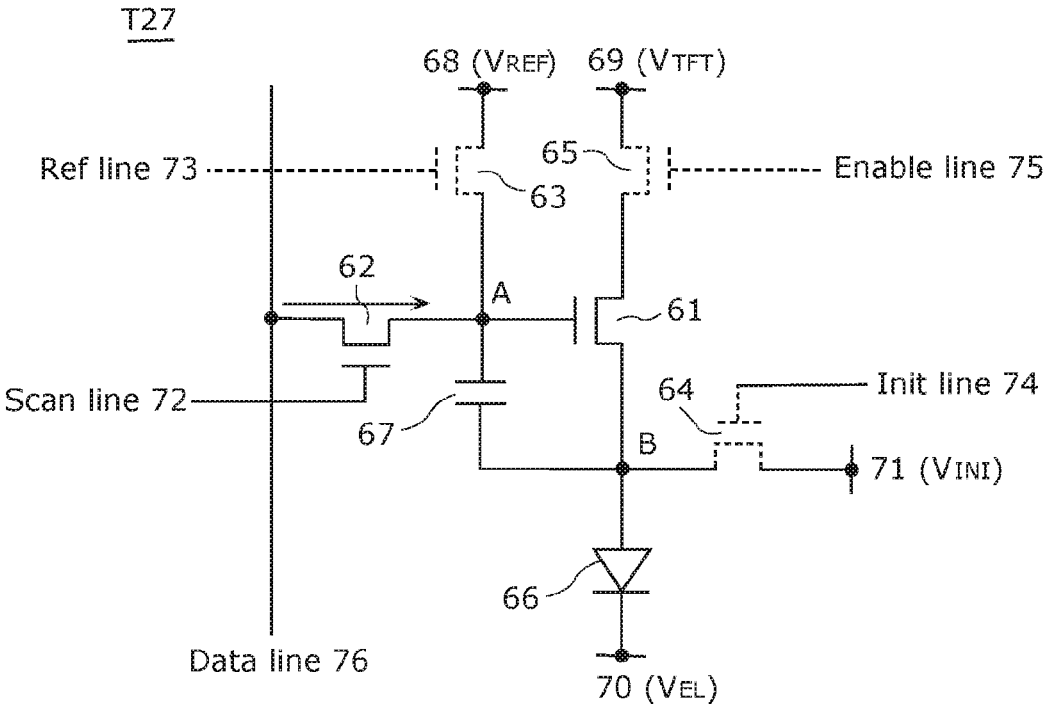
FIG. 4G is a diagram illustrating an example of an operation performed by the pixel circuit in the timing diagram of FIG. 3.

More specifically, as illustrated as an operation state of the pixel circuit 60 in FIG. 4G, at time t6, the scan line drive circuit 3 maintains the voltage levels of the init line 74, the ref line 73, and the enable line 75 LOW, and changes the voltage level of the scan line 72 from LOW to HIGH. In other words, at time t6, the switch 63, the switch 64, and the enable switch 65 are kept being in the electrically non-conductive state (OFF), and the switch 62 is changed to be an electrically conductive state (ON).

As a result, the capacitor 67 records (holds) the threshold voltage Vth of the drive transistor 61 which has been recorded in the threshold compensation period, and also a voltage which is obtained by multiplying a potential difference between the image signal voltage and the voltage $V_{REF}$ of the reference voltage power line 68 by (capacitance of EL element 66)/(capacitance of EL element 66+capacitance of capacitor 67). Since the enable switch 65 is in the electrically non-conductive state, the drive transistor 61 does not cause a drain current to flow. As a result, the potential of the node B is not significantly changed in the period T27.

With enlargement of a display screen (increase of the display panel 6 in size) and increase of the number of the pixel circuits 60, a period (horizontal scan period) for wiring image signals to the pixel circuits 60 is shortened. Since a line time constant of the scan line 72 increases as the display screen increases, it is difficult to shorten the horizontal scan period and also to apply predetermined graduation voltages to the pixel circuits 60.

Therefore, in the present embodiment, as illustrated in FIG. 3, in order to retrieve the image signal (data signal voltage) in a limited period, a period (period T27) in which the switch 62 is set to be an electrically conductive state is extended. Furthermore, in the present embodiment, even if the scan line 72 has waveform rounding, it is possible to complete rising of the scan line 72 before input of a predetermined image signal (data signal voltage) to the data line 76, thereby setting the switch 62 to be an electrically conductive state (ON). This is because varying of the potential of the node B is not large in the period T27.

As a result, even if the display panel 6 has a large display screen and a large number of pixels which cause a large load (line time constant) of the scan line 72 and needs a time for rising, the writing is successfully performed.

Furthermore, the above-described driving can further decrease the line width of the scan line 72. In this case, it is possible to increase a size (capacitance) of the capacitor 67 by an amount of the decrease in the line width, thereby enhancing display performance.

Regarding the display performance, since a drain-gate parasitic capacitance of the drive transistor 61, the capacitor 67, and the capacitance of the EL element 66 are connected in series, if the capacitor 67 is small, voltage varying of the EL cathode power line 70 causes a prominent problem of changing a charge amount written in the capacitor 67. Therefore, a ratio between the parasitic capacitance and the capacitor is important for the display performance. Preferably, the ratio is capacitance of capacitor/parasitic capacitance>>1.

As described above, in the period T27 (writing period), a voltage corresponding to a data signal voltage (image signal voltage) and the threshold voltage of the drive transistor 61 is recorded (held) in the capacitor 67.

(Period T28)

A period T28 from time t7 to time t8 in FIG. 3 is a period in which the switch 62 is surely set to be an electrically non-conductive state.

Figure 4H:
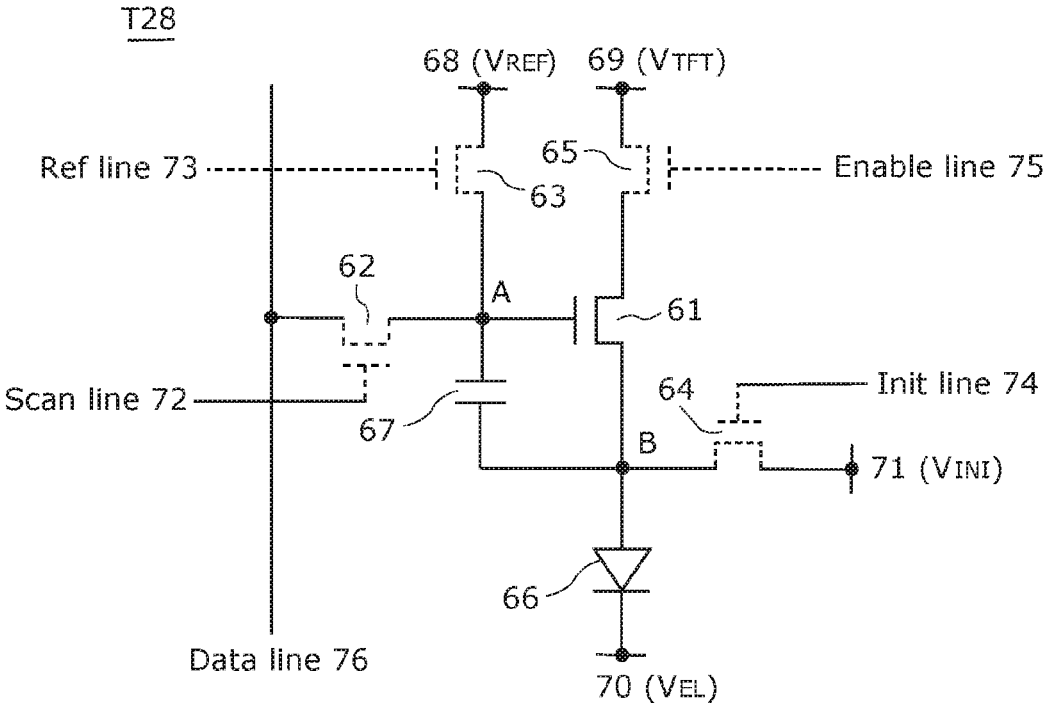
FIG. 4H is a diagram illustrating an example of an operation performed by the pixel circuit in the timing diagram of FIG. 3.

More specifically, as illustrated as an operation state of the pixel circuit 60 in FIG. 4H, at time t7, the scan line drive circuit 3 maintains the voltage levels of the ref line 73, the init line 74, and the enable line 75 LOW, and changes the voltage level of the scan line 72 from HIGH to LOW. In other words, at time t7, the switch 63, the switch 64, and the enable switch 65 are kept being in the electrically non-conductive state (OFF), and the switch 62 is changed to be an electrically non-conductive state (OFF).

Therefore, it is possible to surely set the switch 62 to be an electrically non-conductive state (OFF) before setting the enable switch 65 to be an electrically conductive state (ON) in the following period T29 (emission period).

If the period T28 is not provided and both the enable switch 65 and the switch 62 are in an electrically conductive state (ON) at the same time, a drain current of the drive transistor 61 increases the potential of the node B and sets the potential of the node A to be the data signal voltage. As a result, the voltage between the source and the gate of the drive transistor 61 is lowered. In this case, there is a problem that light emission has a luminance lower than a desired luminance. In order to prevent this, in the present embodiment, the period T28 is provided to surely set the switch 62 to be an electrically non-conductive state and then set the enable switch 65 to be conducive in the following period T29.

(Period T29: Emission Period)

Next, a period T29 from t8 to t9 illustrated in FIG. 3 is an emission period in which light is emitted.

Figure 4I:
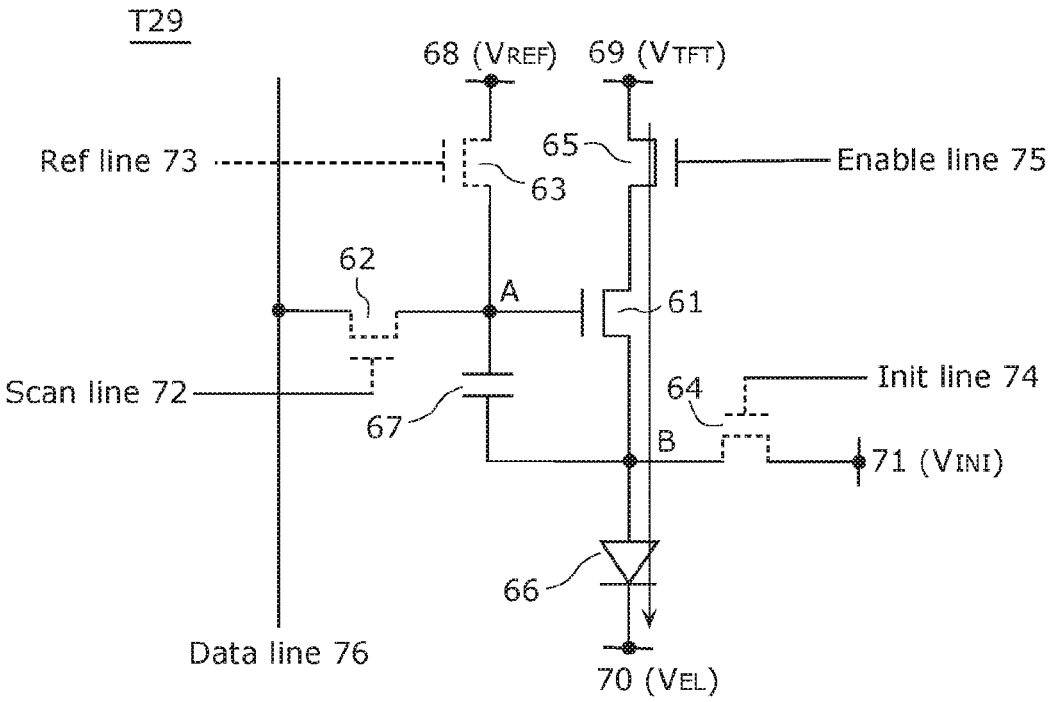
FIG. 4I is a diagram illustrating an example of an operation performed by the pixel circuit in the timing diagram of FIG. 3.

More specifically, as illustrated as an operation state of the pixel circuit 60 in FIG. 4I, at time t8, the scan line drive circuit 3 maintains voltage levels of the scan line 72, the ref line 73, and the init line 74 LOW, and changes a voltage level of the enable line 75 from LOW to HIGH. In other words, at time t8, the switch 62, the switch 63, and the switch 64 are kept being in the electrically non-conductive state (OFF), and the enable switch 65 is changed to be an electrically conductive state (ON).

As described above, the change of the enable switch 65 to be the electrically conductive state (ON) can cause the drive transistor 61 to supply a current to the EL element 66 according to a voltage stored in the capacitor 67, thereby causing the EL element 66 to emit light.

(Period T30)

A period T30 from time t9 to time t0 illustrated in FIG. 3 is a period in which all the switches are set to be non-conducive to change the potential of the node A and the potential of the node B to voltages close to voltages necessary for the period T21.

Figure 4J:
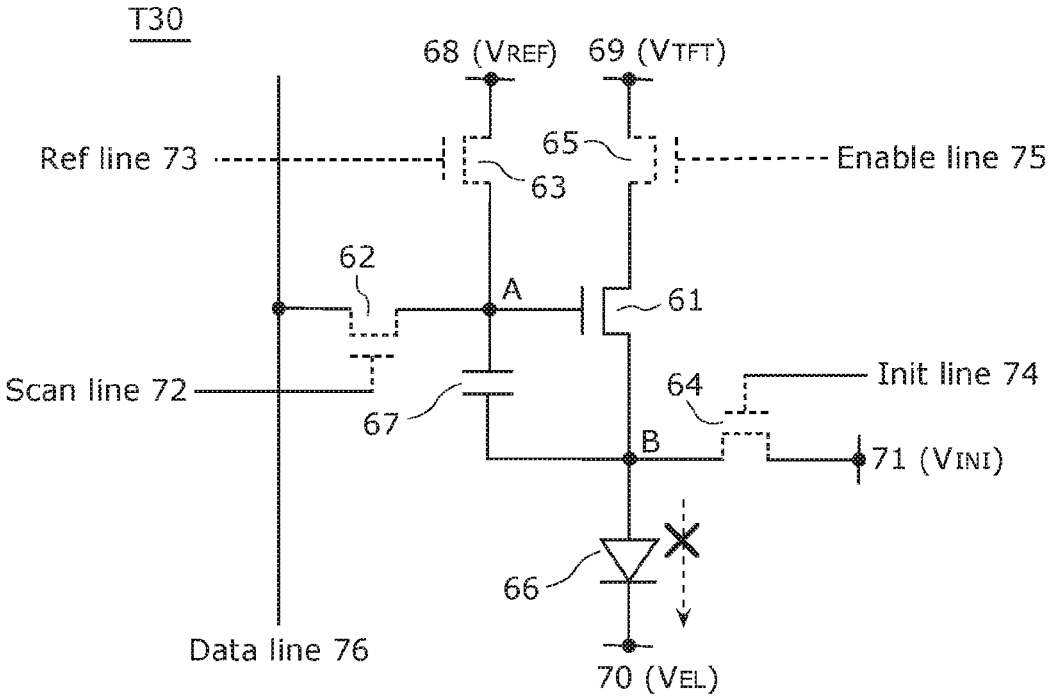
FIG. 4J is a diagram illustrating an example of an operation performed by the pixel circuit in the timing diagram of FIG. 3.

More specifically, as illustrated as an operation state of the pixel circuit 60 in FIG. 4J, at time t9, the scan line drive circuit 3 maintains the voltage levels of the scan line 72, the ref line 73, and the init line 74 LOW, and changes the voltage level of the enable line 75 from HIGH to LOW. In other words, at time t9, the switch 62, the switch 63, and the switch 64 are kept being in the electrically non-conductive state (OFF), and the enable switch 65 is changed to be an electrically non-conductive state (OFF).

As a result, the provision of the period T30 between the period T29 and the period T21 can change the potential of the node A and the potential of the node B to voltages close to voltages necessary for the period T21, without charging/discharging a current through the power lines.

More specifically, in the period T30, the voltage of the node B is converged to a voltage that is a sum of the voltage $V_{EL}$ of the EL cathode power line 70 and the threshold voltage of the EL element 66. Furthermore, in the voltage T30, the voltage of the node A becomes a voltage that is a sum of the voltage of the node B and the voltage stored in the capacitor 67.

In other words, a voltage at the start time of the period T21 (time t0) is lower than a voltage at the end time of the period T29 (time t9) by a voltage obtained by subtracting the threshold voltage from the voltage of the EL element 66 emitting light.

This voltage drop reduces a load in charging/discharging operation caused by the voltage $V_{INI}$ of the initialization power line 71 and the voltage $V_{REF}$ of the reference voltage power line 68 in the period T21.

According to the above-described sequence, the pixel circuit 60 performs gradation display.

It should be noted that the display panel control circuit 2 performs the drive method described as above sequentially on each line to drive the other pixel circuits 60 included in the display panel 6.

As described above, according to the present embodiment, it is possible to provide the drive method and the display device which are capable of high-accurate image display even if a display panel is large in size.

More specifically, for example, the display panel control circuit 2 performs, for each of the pixel circuits 60, an operation of the period T22 (initialization period), in which the drive transistor 61 is initialized, by switching the enable switch 65 (first switch) and the switch 62 (third switch) to an electrically non-conductive state and switching the switch 63 (second switch) and the switch 64 (fourth switch) to an electrically conductive state. Furthermore, the display panel control circuit 2 performs an operation of the period T24 (threshold voltage compensation period), in which the threshold voltage of the drive transistor 61 is compensated, by switching the enable switch 65 (first switch) and the switch 63 (second switch) to an electrically conductive state and switching the switch 62 (third switch) and the switch 64 (fourth switch) to an electrically non-conductive state.

Moreover, for example, for each of the pixel circuits 60, the display panel control circuit 2 starts the period T21 before the period T22 (initialization period) by switching only the switch 64 (fourth switch) to an electrically conductive state, starts the period T22 (initialization period) after the period T21 by switching the switch 63 (second switch) to an electrically conductive state. Here, the display panel control circuit 2 causes the period T21 to be longer than the period T24 (threshold voltage compensation period).

For example, for each of the pixel circuits 60, the display panel control circuit 2 (i) ends the period for light emission of the EL element 66 by switching the enable switch 65 (first switch) to an electrically non-conductive state before the period T21, thereby starting the period T30 in which the enable switch 65 (first switch), the switch 63 (second switch), the switch 62 (third switch), and the switch 64 (fourth switch) have already been switched to an electrically non-conductive state, and (ii) starts the period T21 after the period T30 by switching the switch 64 (fourth switch) to an electrically conductive state.

Furthermore, for each of the pixel circuits 60, the display panel control circuit 2 (i) ends the period T24 (threshold voltage compensation period) by switching the enable switch 65 (first switch) to an electrically non-conductive state, thereby starting the period T25 following the period T24 (threshold voltage compensation period), and (ii) starts the period T27 (writing period) after the period 125 to apply a voltage to the capacitor 67. In the period T27 (writing period), the switch 62 (third switch) has already been switched to an electrically conductive state, and the enable switch 65 (first switch), the switch 63 (second switch), and the switch 64 (fourth switch) have already been switched to an electrically non-conductive state.

For example, for each of the pixel circuits 60, the display panel control circuit 2 (i) ends the period T25 by switching the switch 63 (second switch) to an electrically non-conductive state, thereby starting the period T26 following the period T25, and (ii) ends the period T26 by switching the switch 62 (third switch) to an electrically conductive state, thereby starting the period T27 (writing period) following the period 126.

As described above, according to the present invention, it is possible to provide the drive method and the display device which are capable of high-accurate image display even if a display panel is large in size.

Although the display device and the drive method according to one or more aspects of the present invention have been described based on the foregoing embodiments, the present invention is not limited to the embodiment. Forms obtained by various modifications to the exemplary embodiment that can be conceived by a person of skill in the art as well as forms realized by combining structural components in different exemplary embodiments, which are within the scope of the essence of the present invention may be included in one or more aspects.

It should be noted that, in the present invention, the thin-film transistors (TFT) serving as the switches 62 to 64, the enable switch 65, and the drive transistor 61 may be n-type transistors, be p-type transistors, or include both n-type and p-type transistors. Furthermore, the channel layer of the TFT may comprise any one of amorphous silicon, microcrystalline, polysilicon, oxide semiconductor, organic semiconductor, and the like.

It should also be noted that the EL element 66 is typically an organic light-emitting element, but may be any current-light conversion device in which a light emission intensity varies depending on a current.

INDUSTRIAL APPLICABILITY

Figure 8:
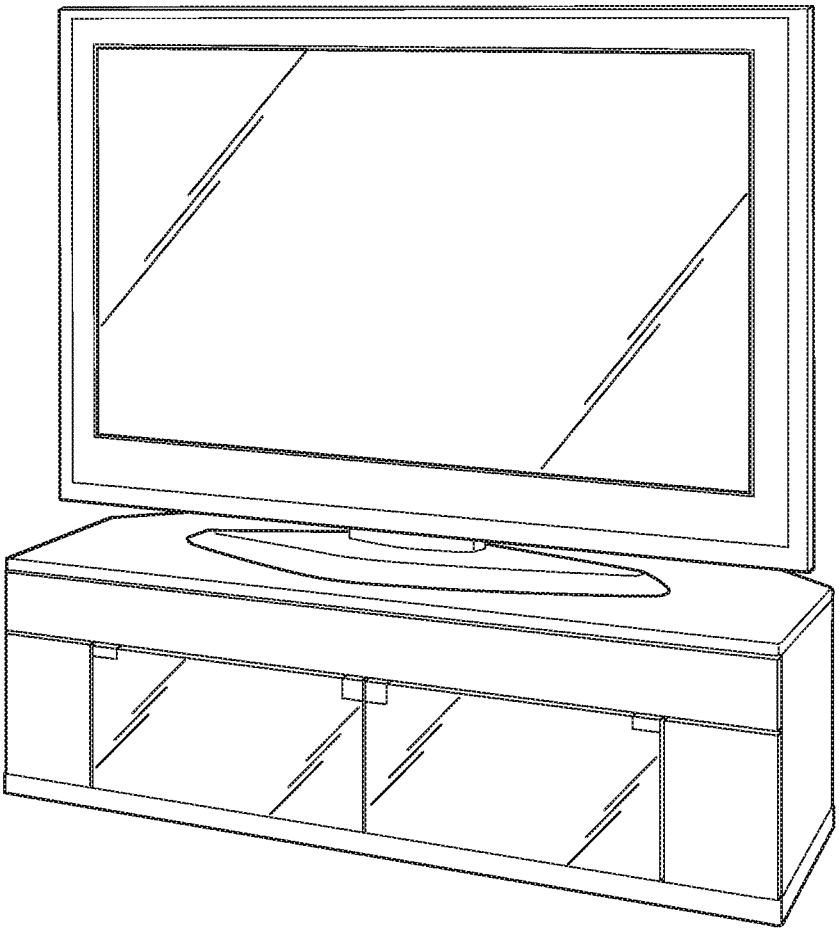
FIG. 8 is an external view of a thin flat TV in which the display device according to the present disclosure is provided.

The present invention can be used as display devices and drive methods of driving the display devices. In particular, the present invention can be used as a Full Page Display (FPD) device, such as a television set as illustrated in FIG. 8.

REFERENCE SIGNS LIST

1 display device
2 display panel control circuit
3 scan line drive circuit
5 data line drive circuit
6, 6A display panel
30, 32, 33 flexible printed circuit
31, 31A, 31B driver IC
60 pixel circuit
61 drive transistor
62, 63, 64 switch
65 enable switch
66 EL element
67 capacitor
68 reference voltage power line
69 EL anode power line
70 EL cathode power line
71 initialization power line
72 scan line
73 ref line
74 init line
75 enable line
76 data line

The invention claimed is:

1. A drive method used in a display device including a plurality of display pixels arranged in a matrix, each of the display pixels including:

a light-emitting element;

a capacitor that holds a voltage;

a drive transistor having a gate electrode and a source electrode, the gate electrode being electrically conductive with a first electrode of the capacitor, and the source electrode being electrically conductive with a second electrode of the capacitor and an anode of the light-emitting element;

a first switch that switches between an electrically conductive state and an electrically non-conductive state between a first power line and a drain electrode of the drive transistor;

a second switch that switches between an electrically conductive state and an electrically non-conductive state between a second power line and the first electrode of the capacitor;

a third switch that switches between an electrically conductive state and an electrically non-conductive state between a signal line for supplying a data signal voltage and the first electrode of the capacitor; and a fourth switch that switches between an electrically conductive state and an electrically non-conductive state between the second electrode of the capacitor and a fourth power line, each of the display pixels having:

an initialization period in which the first switch and the third switch have already been switched to an electrically non-conductive state and the second switch and the fourth switch have already been switched to an electrically conductive state to initialize the drive transistor; and a threshold voltage compensation period in which the first switch and the second switch have already been switched to an electrically conductive state and the third switch and the fourth switch have already been switched to an electrically non-conductive state to compensate a threshold voltage of the drive transistor, and the drive method comprising, for each of the display pixels:

starting a first period before the initialization period by switching only the fourth switch among the first switch, the second switch, the third switch, and the fourth switch to an electrically conductive state; and starting the initialization period following the first period, by switching the second switch to an electrically conductive state, wherein the first period is longer than the threshold voltage compensation period, is 1.6 times to 4 times as long as the threshold voltage compensation period, and causes a potential of the second electrode of the capacitor to decrease to a voltage close to a voltage of the fourth power line.

2. The drive method according to claim 1, wherein the fourth power line is arranged in a direction perpendicular to the first power line and the second power line.

3. The drive method according to claim 1, further comprising, for each of the display pixels:

starting a second period before the first period, by ending an emission period by switching the first switch to an electrically non-conductive state, the second period being a period in which the first switch, the second switch, the third switch, and the fourth switch have already been switched to an electrically non-conductive state, the emission period being a period in which the light-emitting element emits light; and starting the first period following the second period, by switching the fourth switch to an electrically conductive state.

4. The drive method according to claim 1, wherein each of the first switch, the second switch, the third switch, the fourth switch, and the drive transistor is an N-channel thin-film transistor.

5. A display device comprising a plurality of display pixels arranged in a matrix, each of the display pixels having:

a light-emitting element;

a capacitor that holds a voltage;

a drive transistor having a gate electrode and a source electrode, the gate electrode being electrically conductive with a first electrode of the capacitor, and the source electrode being electrically conductive with a second electrode of the capacitor and an anode of the light-emitting element;

a first switch that switches between an electrically conductive state and an electrically non-conductive state between a first power line and a drain electrode of the drive transistor;

a second switch that switches between an electrically conductive state and an electrically non-conductive state between a second power line and the first electrode of the capacitor;

a third switch that switches between an electrically conductive state and an electrically non-conductive state between a signal line for supplying a data signal voltage and the first electrode of the capacitor;

a fourth switch that switches between an electrically conductive state and an electrically non-conductive state between the second electrode of the capacitor and a fourth power line; and a control circuit configured to cause:

an initialization period in which the first switch and the third switch have already been switched to an electrically non-conductive state and the second switch and the fourth switch have already been switched to an electrically conductive state to initialize the drive transistor; and a threshold voltage compensation period in which the first switch and the second switch have already been switched to an electrically conductive state and the third switch and the fourth switch have already been switched to an electrically non-conductive state to compensate a threshold voltage of the drive transistor, wherein the fourth power line is arranged in a direction perpendicular to the first power line and the second power line, the control circuit is further configured to, for each of the display pixels:

cause a first period to start before the initialization period by switching only the fourth switch to an electrically conductive state; and cause the initialization period following the first period to start by switching the second switch to an electrically conductive state, and the first period being longer than the threshold voltage compensation period, being 1.6 times to 4 times as long as the threshold voltage compensation period, and causing a potential of the second electrode of the capacitor to decrease to a voltage close to a voltage of the fourth power line.

* * * * *